US007318274B2

(12) United States Patent
Ichikawa et al.

(10) Patent No.: US 7,318,274 B2
(45) Date of Patent: Jan. 15, 2008

(54) METHOD FOR FITTING WATERPROOF SEAL MEMBERS OVER ELECTRIC WIRES

(75) Inventors: Masaharu Ichikawa, Yokkaichi (JP); Hatsuo Yamada, Haramachi (JP); Kazuhiro Sato, Haramachi (JP); Yuji Izumida, Odaka-machi (JP); Masahiro Toyoda, Soma (JP)

(73) Assignees: Sumitomo Wiring Systems, Ltd. (JP); Japan Automotive Machine Co., Ltd. (JP)

( * ) Notice: Subject to any disclaimer, the term of this patent is extended or adjusted under 35 U.S.C. 154(b) by 454 days.

(21) Appl. No.: 10/758,792

(22) Filed: Jan. 16, 2004

(65) Prior Publication Data

US 2004/0143965 A1 Jul. 29, 2004

(30) Foreign Application Priority Data

Jan. 21, 2003 (JP) ..... 2003-012607

(51) Int. Cl.
*H01R 43/04* (2006.01)

(52) U.S. Cl. ..... 29/861; 29/863; 29/862; 29/854; 29/876; 29/882; 439/587

(58) Field of Classification Search ..... 29/450, 29/433, 838, 845, 857, 861, 881, 235, 729; 439/587, 274; 174/84 R, 94 R
See application file for complete search history.

(56) References Cited

U.S. PATENT DOCUMENTS 5,007,164 A * 4/1991 Kato ..... 29/854
5,351,385 A * 10/1994 Takano ..... 29/450
5,743,002 A * 4/1998 Ito et al. ..... 29/754
5,926,947 A * 7/1999 Takano et al. ..... 29/754
6,134,769 A 10/2000 Takano et al.
6,671,954 B2 * 1/2004 Nomoto ..... 29/881
6,742,251 B1 * 6/2004 Fukase ..... 29/863

FOREIGN PATENT DOCUMENTS

| | | |
|---|---|---|
| EP | 0 701 307 A1 | 3/1996 |
| EP | 0 881 720 A2 | 12/1998 |
| EP | 1 016 496 A1 | 7/2000 |
| JP | 60-29249 | 2/1985 |
| JP | 5-299149 | 11/1993 |
| JP | 6-189429 | 7/1994 |
| JP | 11-345668 | 12/1999 |

* cited by examiner

*Primary Examiner*—Minh Trinh
(74) *Attorney, Agent, or Firm*—Gerald E. Hespos; Anthony J. Casella

(57) ABSTRACT

A method is provided for fitting waterproof seals onto outer peripheries of end portions of electric wires. The method feeds seals along the axis line of the wire and into a seal cavity. A passage forming member forms a feeding passage to feed the seal into the seal cavity with a posture to receive the electric wire. The seal then is locked in the seal cavity. The wire then is moved along the axis line and into the seal.

6 Claims, 15 Drawing Sheets

METHOD FOR FITTING WATERPROOF SEAL MEMBERS OVER ELECTRIC WIRES

BACKGROUND OF THE INVENTION

1. Field of the Invention

The present invention relates to a technology for waterproof seal members substantially cylindrical such as rubber plugs fitting over end portions of electric wires, and more particularly to a technology for waterproof seal members to fit over end portions of electric wires by directly feeding the waterproof seal members successively toward each electric wire at a high speed by pneumatic means such as the compressed air to remarkably improve the efficiency and the yield in the fitting operation. Hereinafter, the waterproof seal members are merely called as "seal members".

2. Description of the Related Art

Conventionally, in electric wire connectors of connecting electric wires with each other, an insulative sheath of an electric wire is stripped off to expose a conductor wire, a terminal is crimped to an end portion of the electric wire where the conductor wire is exposed, and then the terminal crimped on the electric wire is fixed in a connector housing. If water or moist is penetrated into the connector housing along the electric wire, the penetrated water may cause short circuit. In order to prevent penetration of water or moist, some connectors have such a waterproof construction that a seal member is mounted on an end portion of an electric wire, and the seal member mounted on the end portion of the electric wire is inserted into a cavity of the connector housing. A seal member, such as a rubber plug is generally a cylindrical-shaped rubber product formed with a lock member passage for passing an electric wire therethrough. The seal member has a multi-step portion on the outer surface thereof.

Various arrangements as disclosed in the below-mentioned prior art documents have been proposed to fit seal members over end portions of electric wires.

Japanese Unexamined Patent Publication No. SHO 60-29249, see FIG. 6, discloses a supporter of angular shape in cross section having a half cylindrical receiving dent at a side of tip portion to receive substantially a cylindrical part of a seal member in an axial direction of an electric wire. The supporter is moved toward the electric wire in a state that a seal member supplied from a magazine be held in the dent, whereby the seal member fits over the tip of the securely fixed electric wire.

Japanese Unexamined Patent Publication No. HEI 5-299149, see FIG. 3, discloses a pair of sticks extending parallel to each other. The sticks are moved closer to a seal member supplied from a magazine for insertion into an lock member passage of the seal member, followed by enlarging the lock member passage by moving the sticks away from each other in order to pass an electric wire through the enlarged lock member passage of the seal member, whereby the seal member fits over an end of the electric wire.

Japanese Unexamined Patent Publication No. HEI 6-189429, see FIGS. 4 through 14, discloses an arrangement provided with a cylinder for inserting a rod into an lock member passage of a seal member by fitting the seal member thereon to supply the seal member to a feeder, means for transporting the seal member held on an end portion of the rod to a holder while pivoting the cylinder by 90°, and a holder for receiving the seal member from the rod to feed the seal member to an electric wire.

Japanese Unexamined Patent Publication No. HEI 11-345668 discloses an arrangement for feeding a seal member by compressed air to be mounted on an end portion of an electric wire.

FIG. 1 is a partially enlarged view of the arrangement disclosed in the above-referenced Japanese Unexamined Patent Publication No. HEI 11-345668, see FIGS. 8 through 15. Referring to FIG. 1, a seal feeding hose 4 is extended from a parts feeder (not shown) and connected with a hose supporting block 3. A seal member 2 to fit over an end portion of an electric wire W is fed inside the seal feeding hose 4 by the compressed air in the direction as shown by the arrow A. A holder supporting block 5 is arranged behind the hose supporting block 3. A seal holder 6 is attached to the holder supporting block 5. After being fed into the seal feeding hose 4, the seal member 2 is seated in a hole 6*a* in the seal holder 6. At this time, an air suction hose 7 mounted on the other end of the holder supporting block 5 opposite to the seal holder 6 sucks the air inside the hole 6*a* in the direction shown by the arrow B. Thus, the seal member 2 is kept in close contact with the bottom of the hole 6*a*.

Next, as shown in FIG. 2, the holder supporting block 5 is pivoted by 90° in the direction shown by the arrow C to turn the seal member 2 face to a pair of wire guide blocks 8*a* and 8*b*. Thereafter, the tip of the electric wire W is passed into an lock member passage of the seal member 2 by moving the electric wire W in the direction shown by the arrow D.

After completion of fitting the seal member 2 over the end portion of the electric wire W, the electric wire W can be taken out by moving the wire guide members 8*a* and 8*b* away from each other.

However, both of the arrangements shown in D1 and D2 are configured such that seal members are supplied by the magazine, which makes it difficult to efficiently mount the seal members on end portions of electric wires. Particularly, in D1, it is required to transport a seal member in a state that the seal member is held in the cylindrical receiving dent of the supporter having such a configuration as to correspond to a substantially half part of the seal member. With such an arrangement, it is likely that the held position of the seal member may be inaccurately dislocated during the transportation after the compressed air, thereby lowering the yield in mounting the seal members on the end portions of electric wires.

Further, it is required to pivot the cylinder by 90° in order to transport a seal member from the feeder to the holder in the arrangement disclosed in D3, which takes a time in transportation of the seal member 2.

The arrangement disclosed in D4 is capable of feeding seal members 2 at a high speed by the compressed air. However, each seal member 2 is supplied into the hole 6*a* of the seal holder 6, in place of using the wire guide blocks 8*a* and 8*b*. In addition, it is required to pivot each of the holder supporting block 5, the seal holder 6, and the air suction hose 7 by 90° each time a seal member is mounted on an electric wire. Such an arrangement reduces efficient mounting of seal members onto end portions of electric wires.

SUMMARY OF THE INVENTION

An object of the present invention is to eliminate the drawbacks residing in the prior arts and to efficiently carry out fitting of seal members over end portions of electric wires.

According to an aspect of the present invention, a seal cavity for receiving a seal member is defined at a predetermined fitting position on the axis line of an electric wire to fit the cylindrical seal member over the outer periphery of the end portion of the electric wire. The seal member is fed into the seal cavity defined at the fitting position with such a posture as to receive an electric wire by the compressed air. After being fed to the fitting position, movement of the seal member is locked thereat. Then, the electric wire is inserted into the lock member passage of the seal member in the locked state. After the insertion, the movement of the seal member is unlocked.

According to the above arrangement of the present invention, the seal member is directly fed into the seal cavity defined at the fitting position by the compressed air. Accordingly, feeding of the seal member is completed in a very short cycle of time. Thereby, the seal member is efficiently mounted on the end portion of the electric wire. Since the seal member is directly fed into the seal cavity defined at the fitting position, there is no need of moving the seal member after the feeding, thereby suppressing positional displacement of the seal member. Since movement of the seal member in the seal cavity is locked, the electric wire can be securely inserted into the lock member passage of the seal member.

These and other objects, features and advantages of the present invention will become more apparent upon reading the following detailed description and accompanying drawings.

DETAILED DESCRIPTION OF THE PREFERRED EMBODIMENTS

Figure 1:
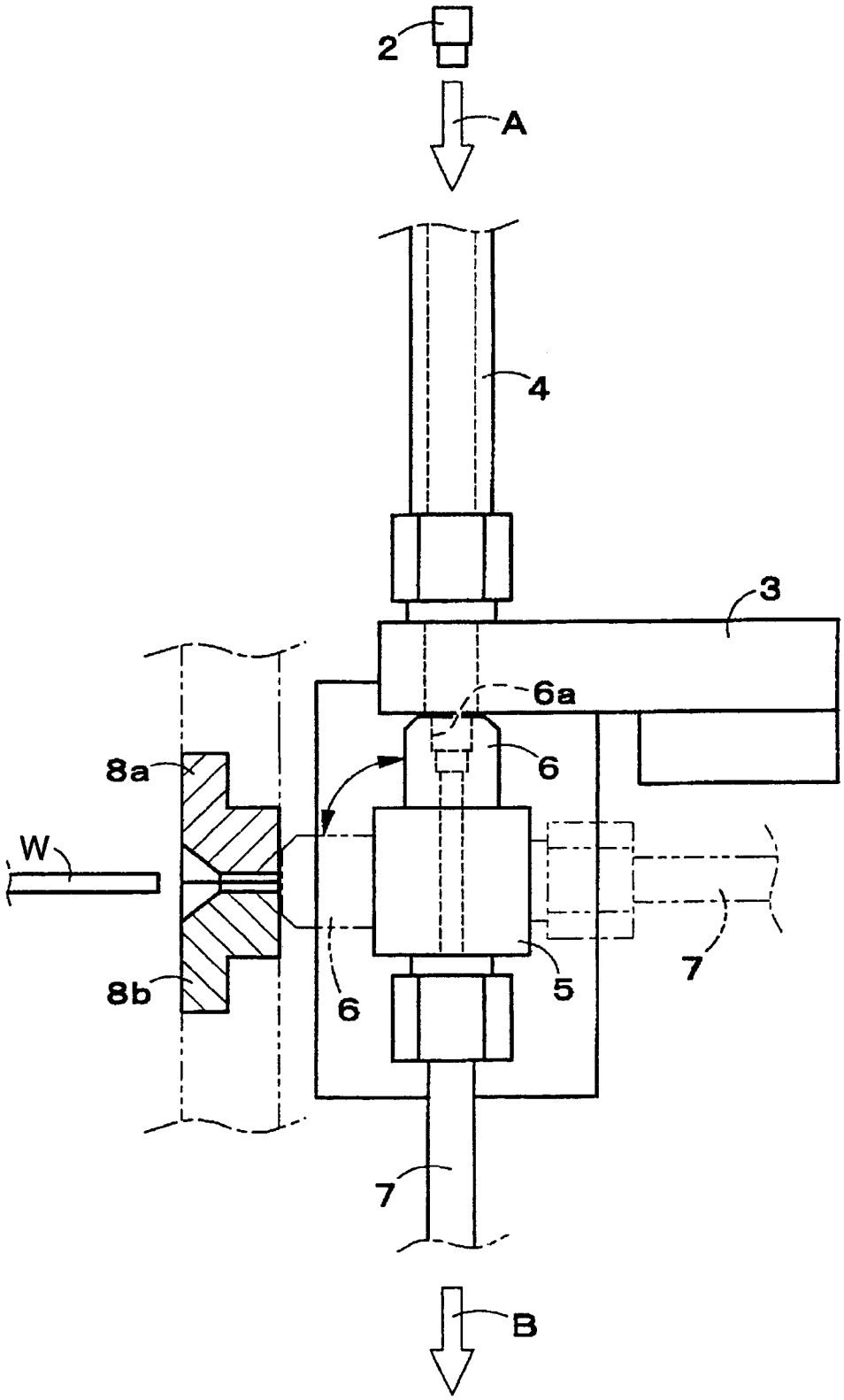
PRIOR ART FIG.1
FIG. 1 is a partially enlarged side view showing a conventional waterproof seal fitting unit as disclosed in Japanese Unexamined Patent Publication No. HEI 11-345668.
Figure 2:
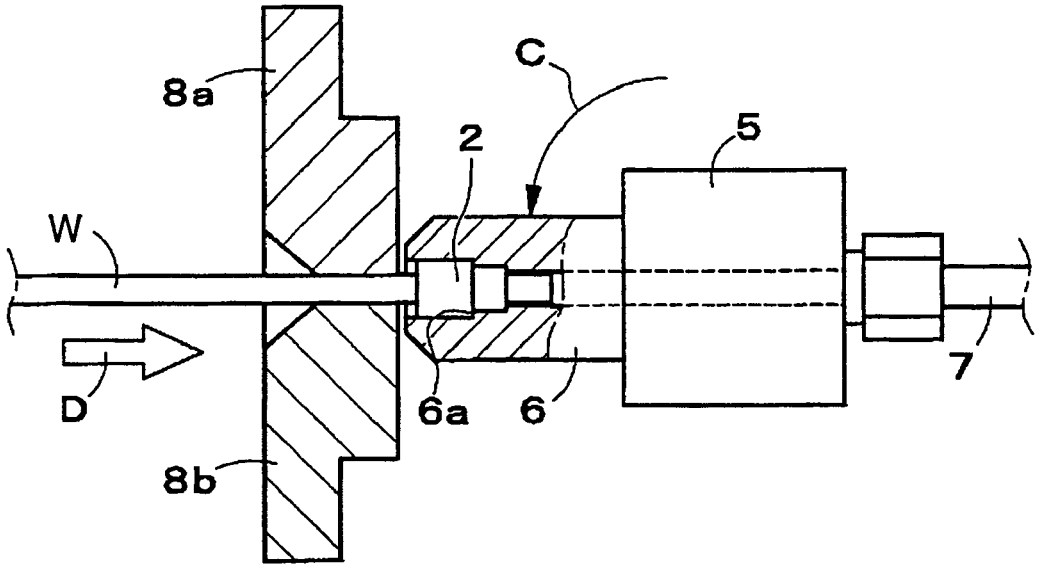
PRIOR ART FIG.2
FIG. 2 is a partially enlarged side view showing the unit in FIG. 1.
Figure 3:
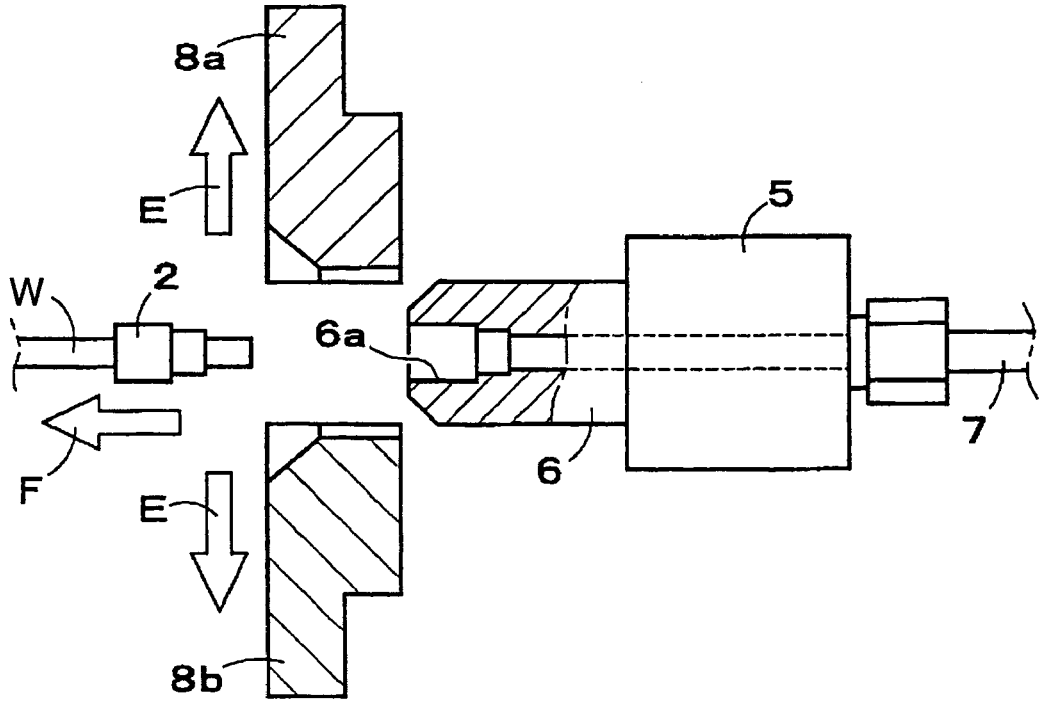
PRIOR ART FIG.3
FIG. 3 is a partially enlarged side view showing the unit in FIG. 1.

Preferred embodiments of the present invention are described in detail referring to FIGS. 4 through 23.

In the following, substantially equivalent elements are denoted by the same reference numerals, and duplicated description thereof will be omitted.

First Embodiment

Figure 4:
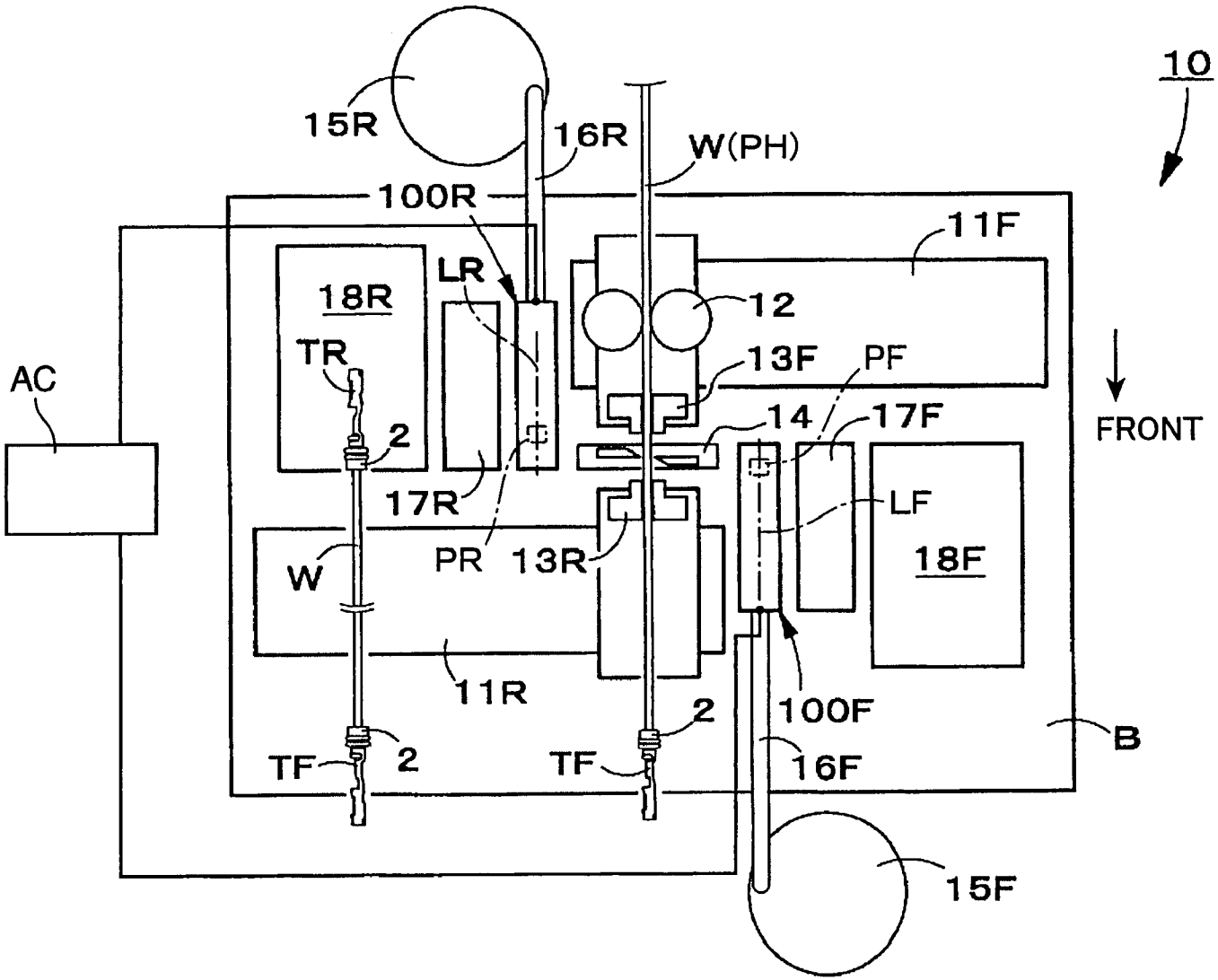
FIG. 4 is a plan view schematically showing an electric wire processing apparatus of the present invention.

Referring to FIG. 4, an electric wire processing apparatus 10 according to an embodiment of the present invention includes: a drive device 11F, an electric wire retrieving/length measuring device 12 (or simply called as "wire retrieving/measuring device 12"), a clamping device 13F, a cutting device 14, all of which are adapted to process a front end of an electric wire; a parts feeder 15F for feeding seal members 2 one by one by the compressed air; a feeding pipe unit 16F; a waterproof seal feeding machine 100F; a stripping device 17F; and a terminal crimping device 18F.

The electric wire processing apparatus 10 further includes a drive device 11R, a clamping device 13R, both of which are adapted to process a rear end of the electric wire W, a parts feeder 15R for feeding seal members 2 one by one by the compressed air, a feeding pipe unit 16R, a waterproof seal feeding machine 100R, a stripping device 17R, and a terminal crimping device 18R.

In order to supply the compressed air, an air compressor AC is connected with the feeding units 100F and 100R.

Among the aforementioned elements, the drive devices 11F and 11R, and the clamping devices 13F and 13R constitute fitting means in the first embodiment.

The electric wire processing apparatus 10 is operated in such a manner that a seal member 2 is mounted at a predetermined fitting position PF corresponding to a front end of an electric wire W in cooperation with the waterproof seal feeding machine 100F, followed by stripping, crimping of a terminal TF, retrieving of the electric wire by a predetermined length by the wire retrieving/measuring device 12, and cutting by the cutting device 14 to a cut wire (size-adjusted wire). Likewise, another seal member 2 is mounted at a predetermined fitting position PR corresponding to a rear end of the cut wire in cooperation with the waterproof seal feeding machine 100R, followed by stripping and crimping of a terminal TR.

The drive devices 11F and 11R are provided with a uniaxial robot, for instance, to drive the clamping devices 13F and 13R in front and rear directions and in left and right directions of the apparatus 10. The leading and the rear ends of cut wires obtained by cutting with the cutting device 14 are movable back and forth in left and right directions relative to the wire retrieving/measuring device 12 by way of the clamping devices 13F and 13R, and movable back and forth in front and rear directions coaxially along axis lines LF and LR, respectively, while being carried on the drive devices 11F and 11R. The axis lines LF and LR are parallel to a wire feeding path PH defined by the wire retrieving/measuring device 12.

Although briefly illustrated in FIG. 4, the respective axis lines LF and LR are set in plural pairs in correspondence to different kinds of seal members 2.

The fitting positions PF, PR are defined coaxially along the respective axis lines LF and LR. The seal members 2 are fitted over their predetermined respective positions on an electric wire W by passing the electric wire W into the seal members 2 respectively fed to the fitting positions PF and PR one after another.

Next, the waterproof seal feeding machine is described with reference to FIGS. 5 through 13. Since the respective elements located upstream in the wire feeding path PH are identical to the respective elements located downstream in the wire feeding path PH, the designations "F" and "R" for identifying the upstream elements and the downstream elements are omitted in the description relating to FIG. 5 and thereafter.

The waterproof seal feeding machine 100 includes a passage forming member 20 attached to a support member B1 of a base block B of the wire processing apparatus 10. The passage forming member 20 is an integral molded member made of a synthetic resin.

Figure 8:
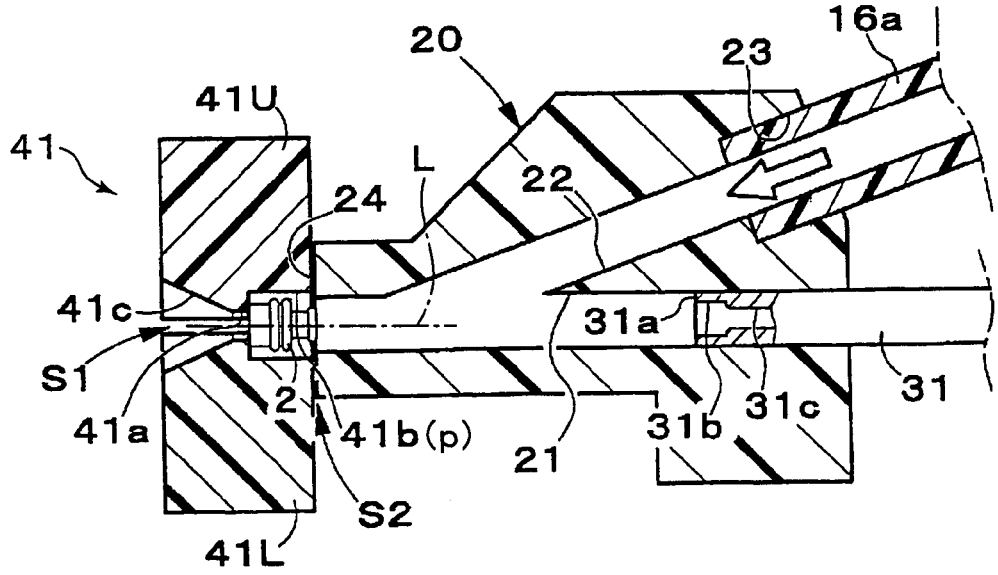
FIG. 8 is a sectional view showing a state that a seal member is fed in the first embodiment.

As illustrated enlargedly in FIG. 8, the passage forming member 20 is formed with an lock member passage 21 coaxially extending along the axis line L defined in the wire processing apparatus 10, and a feeding passage 22 which is merged into the lock member passage 21 at a downstream end (front end) of the lock member passage 21 in the seal member feeding direction and extends obliquely upward relative to the lock member passage 21 toward upstream in the seal member feeding direction. The lock member passage 21 and the feeding passage 22 each has a circular shape in cross section, and has an inner diameter slightly larger than the outer diameter of the seal member 2.

The waterproof seal feeding machine 100 in the first embodiment is constructed such that seal members 2 of three different sizes are selectively capable of fitting over end portions of electric wires without changing the replace or setup operations in fitting the seal member 2 of a desired size. In view of this, three sets of lock member passages 21 and feeding passages 22 are formed side by side in correspondence to the size of the seal member 2 to be fed. The inner diameters of the lock member passage 21 and the corresponding feeding passage 22 are each formed in correspondence to the size of the seal member 2 to be mounted. Specifically, in FIG. 6, the rightmost lock member passage 21 and the corresponding feeding passage 22 each has a smallest inner diameter, the middle lock member passage 21 and the corresponding feeding passage 22 each has a medium size inner diameter, and the leftmost lock member passage 21 and the corresponding feeding passage 22 each has a largest inner diameter.

Figure 7:
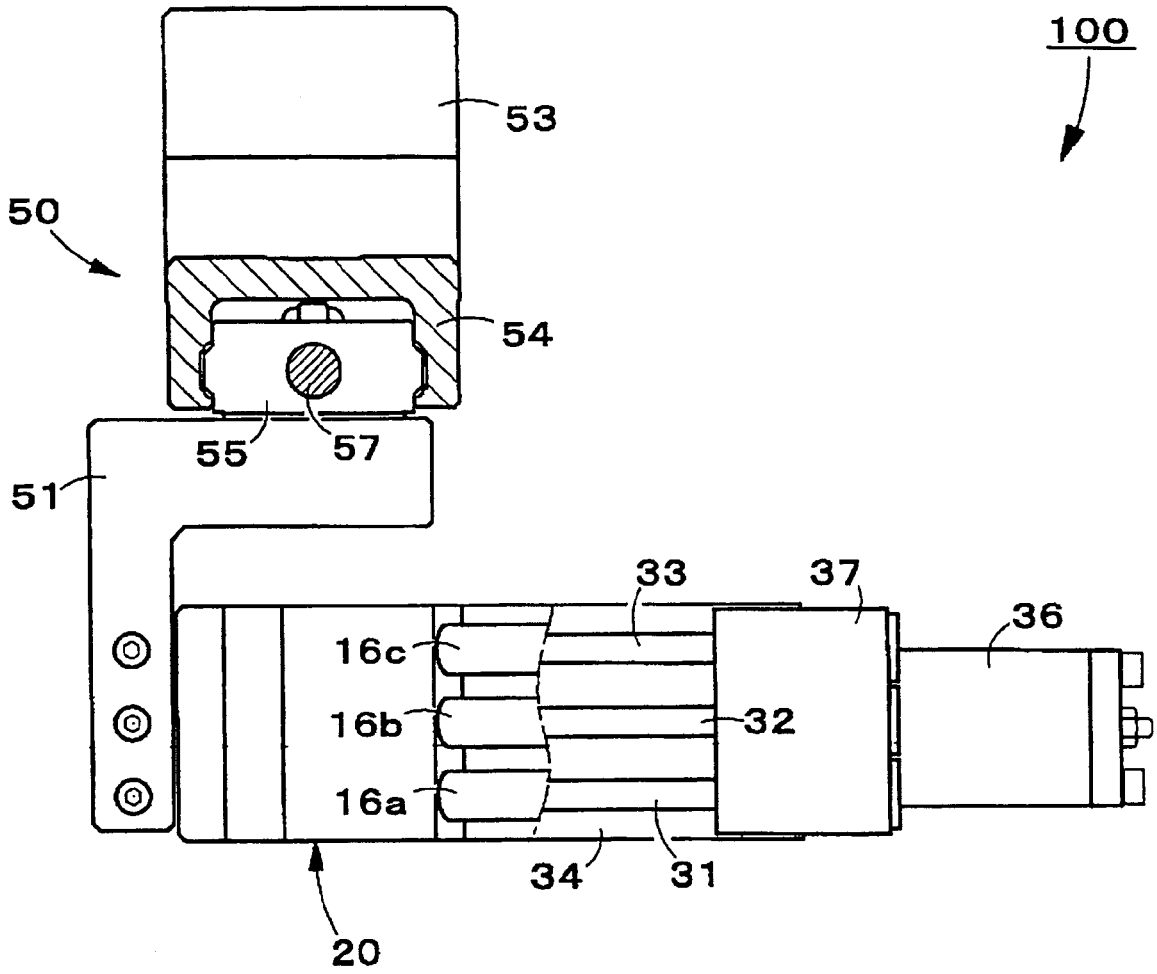
FIG. 7 is a plan view showing the waterproof seal feeding machine as the first embodiment of the present invention.

As shown in FIG. 7, a linearly extending rod-like lock member 31 (32 or 33) having a substantially circular shape in cross section and having an outer diameter generally identical to the outer diameter of the seal member 2 are slidably movable through the corresponding lock member passage 21 along the axis line L. In FIG. 7, the lowermost lock member 31 has a smallest diameter, the middle lock member 32 has a medium size diameter, and the uppermost lock member 33 has a largest diameter among the three lock members 31, 32, 33 in correspondence to the diameter of the corresponding lock member passage 21.

It should be appreciated that since the configurations of the lock members 31 through 33 are identical to each other, the configuration of the lock member 31 is described as a representative of the lock members 31 through 33.

As shown in FIG. 8, a hole 31*b*, having a bottom, is formed axially along the axis line L in a tip 31*a* of the lock member 31. The hole 31*b* is, as will be described later, adapted to secure the seal member 2 coaxially along the axis line L in a seal cavity 41*b* defined at the fitting position P when the lock member 31 moves to the fitting position P. The diameter of the hole 31*b* has such a size as to sufficiently enclose a small-diametrical part of the seal member 2. A small-diametrical opening 31*c* is formed continuously from the bottom part of the hole 31*b* to guide and pass the electric wire W through the coaxially aligned seal member 2 (see FIG. 10).

Figure 5:
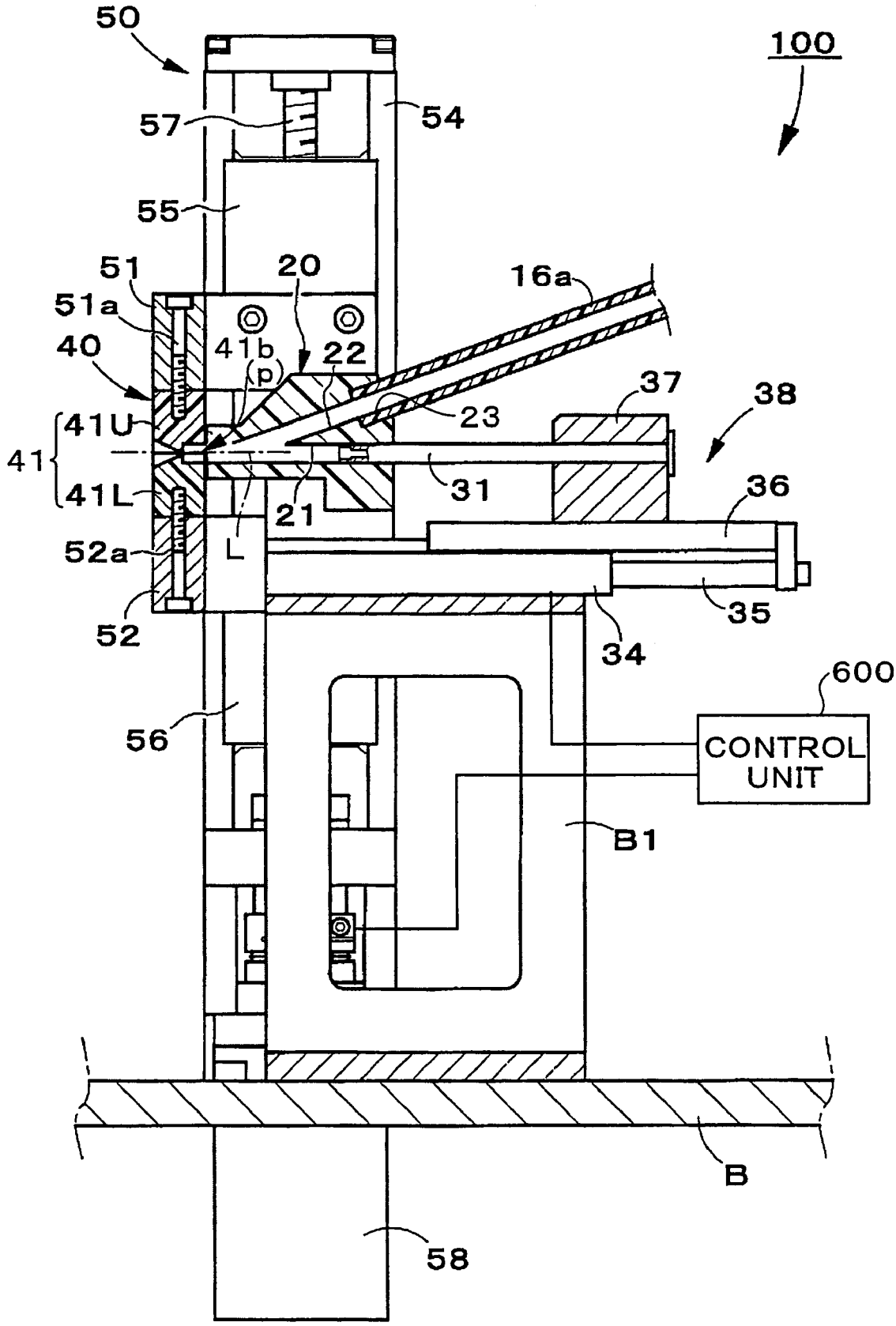
FIG. 5 is a side view showing a waterproof seal feeding machine as a first embodiment of the present invention.

Referring to FIG. 5, a rear end of each of the lock members 31 through 33 is fixed to a block 37 to be integral with the block 37. The block 37 is supported on a bed 36 extending along the axis line L. The bed 36 is arranged at such a position as to be reciprocated along the axis line L by a piston rod 35 of an air cylinder 34. The air cylinder 34 is fixed on the support member B1. In this arrangement, each of the lock members 31 through 33 can be reciprocated on the axis line L via the bed 36 and the block 37 by driving the piston rod 35.

In the above embodiment, a locking mechanism in which the lock members 31 through 33, the air cylinder 34, the bed 36, the block 37, or other component, if necessary, are assembled into one unit constitutes locking means in the embodiment of the present invention.

Each feeding passage 22 has a multi-step circular shape in cross section with a large-diametrical part 23 being formed upstream in the seal member feeding direction, and a merging portion being formed downstream (front most) in the seal member feeding direction. The merging portion merges into the lock member passage 21 on the axis line L. The large-diametrical parts 23 of the feeding passages 22 receive respectively downstream ends of feeding pipes 16*a*, 16*b*, and 16*c* of the feeding pipe unit 16 (see FIG. 7) extending from the corresponding parts feeder 15 (see FIG. 4).

The respective feeding pipes 16*a*, 16*b*, and 16*c* have such configurations as to match with the seal members 2 of the different sizes. Specifically, the feeding pipe 16*a* has a smallest inner diameter, the feeding pipe 16*b* has a medium size inner diameter, and the feeding pipe 16*c* has a largest inner diameter in correspondence to the respective feeding passages 22.

Figure 6:
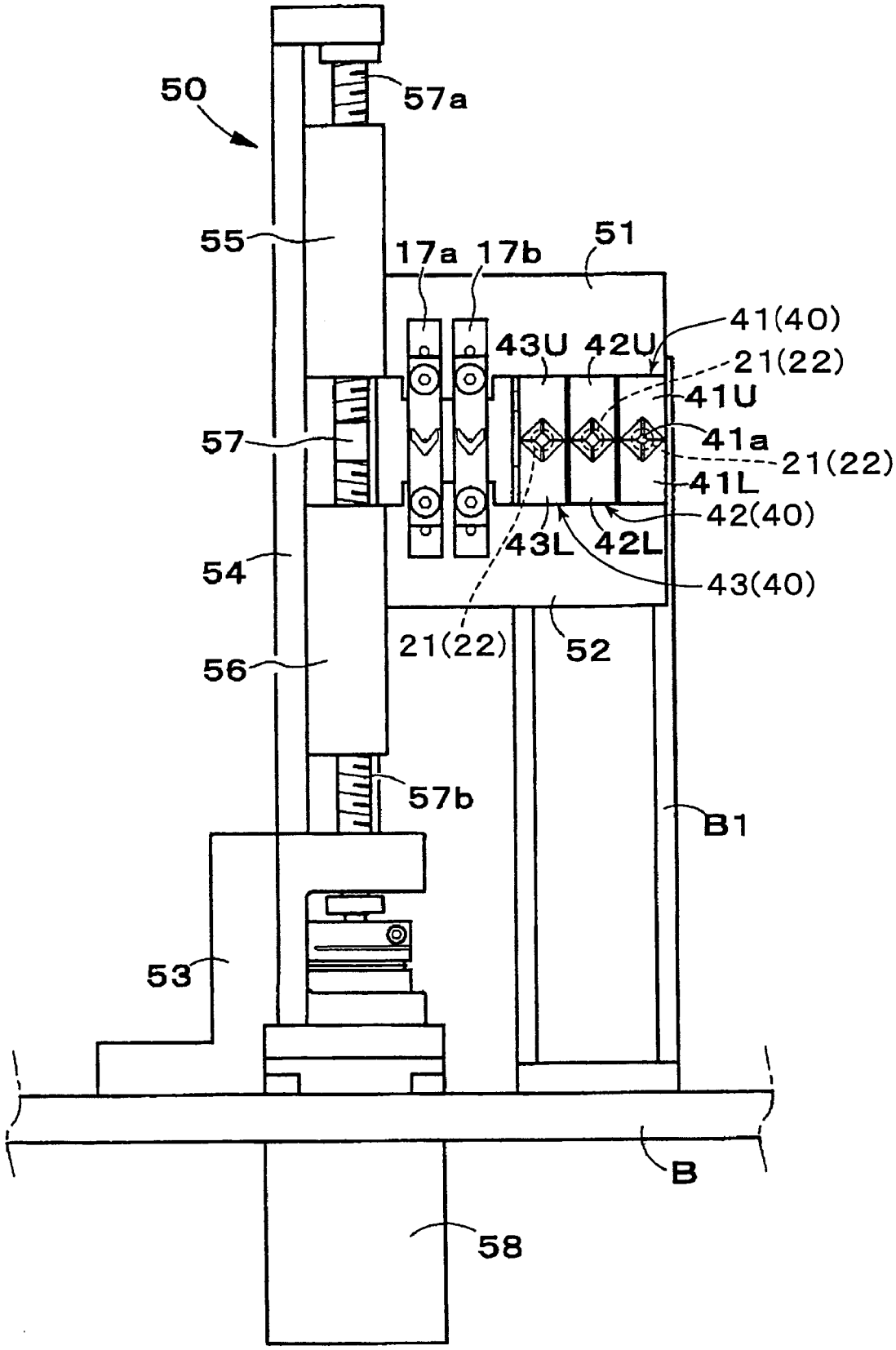
FIG. 6 is a front view showing the waterproof seal feeding machine as the first embodiment of the present invention.

A holder unit 40 is provided in front (left side in FIG. 5) of the passage forming member 20. The holder unit 40 includes three sets of holders 41, 42, and 43 arranged side by side, as shown in FIG. 6. The respective holders 41 through 43 oppose to the three rows of feeding passages 22 formed in the passage forming member 20 coaxially along the axial line L.

Similar to the three feeding passages 22 of the passage forming member 20, as shown in FIG. 6, the holders 41 through 43 are constructed in such a manner that the rightmost holder 41 is adapted for holding the seal member 2 of a smallest size, the middle holder 42 is adapted for holding the seal member 2 of a medium size, and the leftmost holder 43 is adapted for holding the seal member 2 of a largest size. The constructions of the holders 41, 42, and 43 are substantially identical to each other inasmuch as elements for holding the seal members 2 are concerned. Accordingly, merely the relevant portion of the holder 41 for holding a seal member 2 is described in the following.

A pair of holder pair 41U and 41L opposing to each other in upper and lower positions relative to the axis line L constitute the holder 41. The upper and lower holder pair 41U and 41L are vertically movable toward and away from each other in FIG. 5. When the upper and lower holder pair 41U and 41L move to a closed state, the seal cavity 41*b* is defined at the fitting position P defined coaxially on the axis line L in the wire processing apparatus 10 (see FIG. 9). The seal cavity 41*b* is opened toward the passage forming member 20 on the axis line L, and is formed into a stepped cylindrical shape with a through-opening 41*a* being formed in an end wall of the seal cavity 41*b* for passing an electric wire W therethrough. In other words, an upper half part (lower half part) of the through-opening 41*a* and the seal cavity 41*b* is formed in the holder member 41U (41L).

The through-opening 41*a* of the seal cavity 41*b* includes a guide surface 41*c* for guiding a tip of the electric wire W.

In this embodiment, the through-opening 41*a* formed in an end surface of the seal cavity 41*b* has a rectangular shape in cross section, in place of a circular shape. More specifically, the through opening 41*a* has such a rectangular shape in cross section that a pair of opposing vertices of a square are arranged vertically to each other relative to the axis line L (see FIG. 6). With this arrangement, electric wires having different diameters can be retained and guided along the same axis line L in the seal cavity 41*b* by regulating a clearance defined by the upper and lower holder pair 41U and 41L in a closest position.

Referring to FIGS. 5 through 7, the three sets of holders 41, 42, and 43 are fixed by a pair of upper and lower brackets 51 and 52 constituting a holder driving unit 50 serving as holder driving means in the embodiment of the present invention.

The holder driving unit 50 includes a vertically extending guide member 54 fixed and supported on the base block B by a stay 53, a pair of upper and lower sliders 55 and 56 which are operative to reciprocate slidably and vertically while being guided by the guide member 54, a screw shaft 57 extending vertically in engagement with the sliders 55 and 56, and a motor 58 for drivingly rotating the screw shaft 57 in forward and backward directions. A threaded portion 57*a* formed on the upper half of the screw shaft 57 is threaded right-handed, and a threaded portion 57*b* formed on the lower half of the screw shaft 57 is threaded left-handed. With this arrangement, the upper and lower sliders 55 and 56 are movable toward each other by rotating the screw shaft 57 in the forward direction, whereas they are movable away from each other by rotating the screw shaft 57 in the backward direction.

The upper and lower brackets 51 and 52 are fixedly supported by the upper and lower sliders 55 and 56, respectively.

In the embodiment, the upper and lower brackets 51 and 52 of the holder driving unit 50 is equipped with two pairs of stripping blades 17*a* and 17*b* of the stripping device 17, wherein each pair is adapted for stripping off the insulative sheath at the end portion of the electric wire W after fitting of the seal member 2. In this arrangement, operations of the holder driving unit 50 for driving the three holders 41, 42, and 43, and driving means for driving the two pairs of stripping blades 17*a* and 17*b* are integrated to thereby simplify the entire construction of the wire processing apparatus 10.

Furthermore, in the above arrangement, up and down movements of the respective holders 41, 42, and 43, and the respective stripping blade pairs 17*a* and 17*b* are rendered synchronous with each other, whereby processing operation of the end portions of the electric wires can be carried out accurately and efficiently.

Next, operations of producing a size-adjusted wire (cut wire) in the first embodiment are described referring to FIGS. 8 through 13 in the first embodiment.

First, referring to FIG. 4, upon start-up of the wire processing apparatus 10, an electric wire W is retrieved forward by the wire retrieving/measuring device 12. After retrieving the electric wire W by a certain length, the electric wire W is clamped again by the clamping devices 13F and 13R, and then cut by the cutting device 14. With regard to the process of upstream part of the electric wire W, the drive device 11F drives the clamping device 13F transversely toward the waterproof seal feeding machine 100F. Thereby, the upstream part of the electric wire W clamped by the clamping device 13F is transported to the waterproof seal feeding machine 100F.

With regard to the waterproof seal feeding machine 100, as shown in FIGS. 7 and 8, the holder driving unit 50 (FIG. 7) drives the upper and lower holder pair 41U and 41L toward each other to define the seal cavity 41*b*.

At the movement of the upper and lower holder pair 41U and 41L toward each other, the control unit 600 (FIG. 5) serving as controlling means for controlling the operation of the holder driving unit 50 controls the holder driving unit 50 to position the respective upper and lower holder pair 41U and 41L at predetermined upper and lower positions, so that a small clearance S1 is defined between the upper and lower holder pair 41U and 41L.

Subsequently, the parts feeder 15 is actuated. As shown by the arrow in FIG. 8, the compressed air feeds the seal member 2 through the feeding pipe 16*a*, the feeding passage 22 and the merging portion with the lock member passage 21 in this order. Thus, the seal member 2 sits into the seal cavity 41*b*, and is retained at the fitting position P in abutment against the end wall of the seal cavity 41*b*.

In this embodiment, since the small clearance S1 is defined between the upper and lower holder pair 41U and 41L at the time of feeding the seal member 2, the air around the seal cavity 41*b* and the air in the feeding passage 22 are exhaled through the clearance S1 prior to the feeding of the seal member 2.

Further, a clearance S2 is defined between a front surface 24 of the passage forming member 20 and the upper and lower holder pair 41U and 41L. This arrangement is likewise advantageous in exhaling the air remained in the seal cavity

41*b*, the air in the feeding pipe 16*a* prior to the feeding of the seal member 2, and the air in the feeding passage 22 through the clearance S2 in feeding the seal member 2.

In this embodiment, thus the seal member 2 is directly fed into the seal cavity 41*b* by the compressed air and with use of the clearances S1 and S2.

Figure 9:
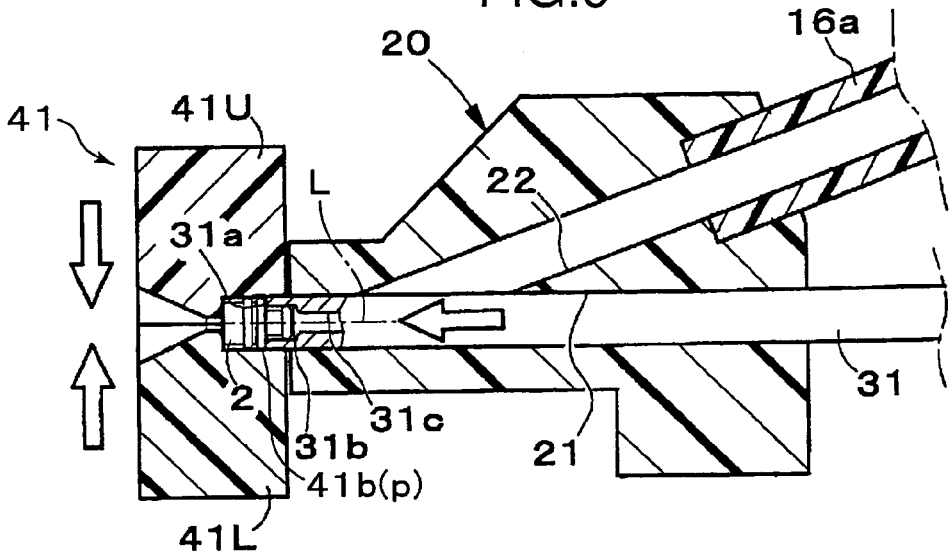
FIG. 9 is a sectional view showing a state that the seal member is fixed in the first embodiment.
Figure 10:
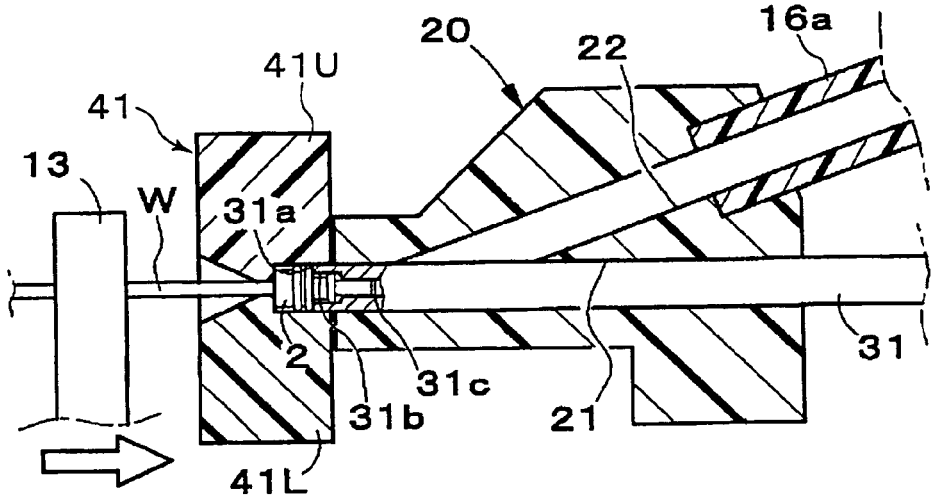
FIG. 10 is a sectional view showing a state that an electric wire is passed through the seal member in the first embodiment.

Upon completion of feeding of the seal member 2 into the seal cavity 41*b*, as shown in FIG. 9, the holder driving unit 50 drives the upper and lower holder pair 41U and 41L in close contact with each other.

Simultaneously, the air cylinder 34 (FIG. 5) serving as lock member driving means in the embodiment of the present invention moves the lock member 31 toward the holder 41. With this arrangement, the tip 31*a* of the lock member 31 pushes the stepped portion between the large-diametrical part and the small-diametrical part of the seal member 2 in a state that the small-diametrical part thereof is wrapped in the hole 31*b*. Thereby, the seal member 2 is locked in a state that its axial and radial displacements thereof relative to the electric wire W are prevented.

When the seal member 2 is locked, the control unit 600 controls the clamping device 13 serving as wire handling means to advance the electric wire W along the axis line L, whereby the tip of the electric wire W is inserted into the seal member 2 placed in the seal cavity 41*b*.

At the time of the insertion, since the tip of the electric wire W enters into the small-diametrical opening 31*c* formed in the tip of the lock member 31, the axial movement of the electric wire W is carried out smoothly.

Figure 11:
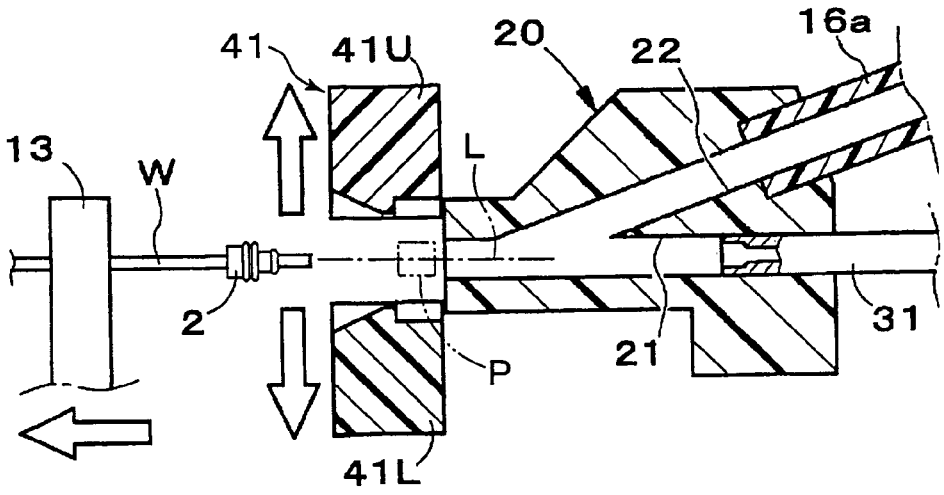
FIG. 11 is a sectional view showing a state that the seal member has fitted over an end portion of the electric wire in the first embodiment.
Figure 12:
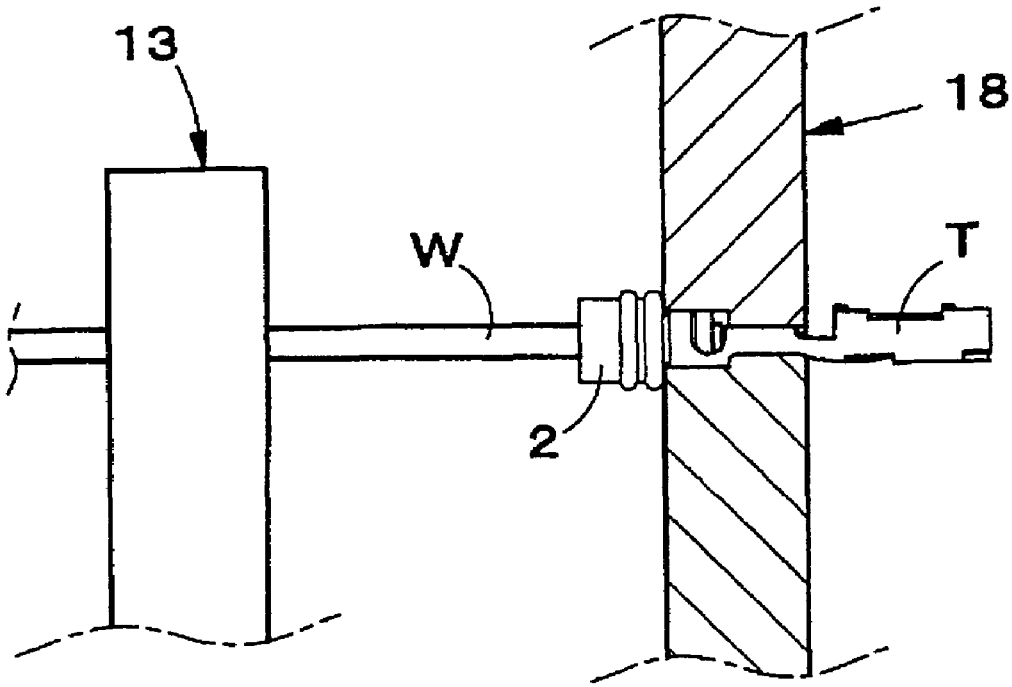
FIG. 12 is a side view showing a state that a terminal is crimped on an end portion of the electric wire in the first embodiment.

When the insertion of the tip of the electric wire W into the seal member 2 is completed, as shown by the vertical arrows in FIG. 11, the control unit 600 controls the upper and lower holder pair 41U and 41L vertically away from each other to thereby open the seal cavity 41*b*. Then, the drive device 11 is actuated to retract the electric wire W with the seal member 2 fitting thereon in the direction shown by the horizontal arrow in FIG. 11 by way of the clamping device 13, and the lock member 31 is retracted upstream relative to the merging portion of the lock member passage 21 and the feeding passage 22, thereby preparing for a next processing.

Upon completion of the fitting of the seal member 2, the control unit 600 is operative to proceed with stripping off of the insulative sheath of the electric wire W and crimping of a terminal (see FIG. 12) in the similar manner as the conventional wire processing system.

Referring back to FIG. 4, after crimping of a terminal TF at a downstream end of the electric wire W in the wire feeding direction, the electric wire W is returned to the wire feeding path PH of the wire processing apparatus 10. The electric wire W is then fed downstream by a certain length, and then cut to produce a cut wire (or size-adjusted wire). After the cutting, a terminal TR is crimped at an upstream end of the cut wire in the wire feeding direction in the similar manner as the downstream end crimping. The upstream end crimping of the terminal TR on the cut wire is carried out in synchronism with a downstream end crimping of another terminal TF which is carried out with respect to an electric wire W following the cut wire. In this embodiment, since operations of the holder driving unit 50 of the waterproof seal feeding machine 100, and the pairs of stripping blades 17*a* and 17*b* are integrated, processing timing at the upstream end of a cut wire and processing timing at the downstream end of the electric wire following the cut wire can be made synchronous with each other.

Figure 13:
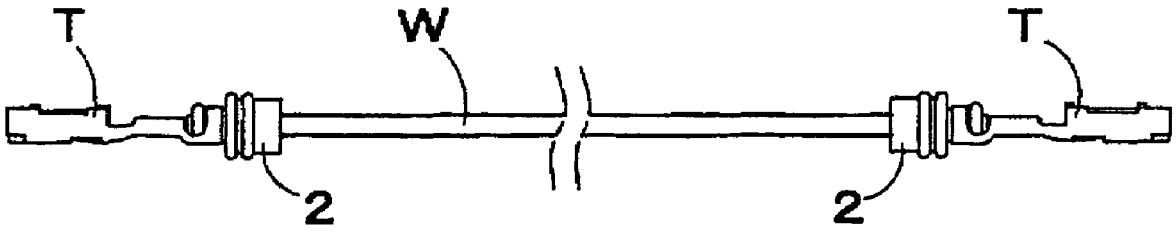
FIG. 13 is a side view showing a state that terminals and seal members are mounted on opposite ends of an electric wire.

As a result of the above processes, a size-adjusted wire (cut wire) W as shown in FIG. 13 is produced.

The waterproof seal feeding machine 100 in the first embodiment is constructed in such a manner that the seal member 2 is directly fed into the seal cavity 41*b* by the compressed air, thereby feeding the seal member 2 within a very short time.

Thus, the seal member 2 can fit over the end portion of the electric wire W with high efficiency.

Furthermore, since the seal member 2 is tightly locked in the seal cavity 41*b* by the lock member 31, the end portion of the electric wire W can be securely passed through the seal member 2.

In case of making the electric wire W of the various diameters without changing the outer diameter of the seal member 2, generally, it is required to replace the holder pair 41U and 41L with another pair of holder pair having a through-opening 41*a* of such a size as to match with the thickness of the electric wire W.

In the waterproof seal feeding machine 100 in the first embodiment, on the contrary, the cross sectional configuration of the through opening 41*a* formed in the bottom of the seal cavity 41*b* is a rhombus in place of a circle. With this arrangement, the through opening 41*a* guides and accurately holds the electric wires W in various sizes by adjusting the clearance between the upper and lower holder pair 41U and 41L.

The control unit 600 also controls the holder driving unit 50 to locate the upper and lower holder pair 41U and 41L to such positions as to match with the outer diameter of the electric wire W in a closest state thereof. More specifically, in case of processing the thick electric wire W, the upper and lower holder pair 41U and 41L are located at such positions as to maximize the clearance between the upper and lower holder pair 41U and 41L in a closest state thereof. On the other hand, in case of processing the thin electric wire W, the upper and lower holder pair 41U and 41L are located at such positions as to minimize the clearance between the upper and lower holder pair 41U and 41L in a closest state thereof.

In the above arrangement of the waterproof seal feeding machine 100 in the first embodiment, even if there is a need of processing of the electric wire W of the various diameters without changing the outer diameter of the seal member 2, there is no need of replacing the upper and lower holder pair 41U and 41L with another pair of upper and lower holder pair having a through opening 41*a* of a different size. Furthermore, this arrangement is advantageous in accurately guiding the electric wire W of a different diameter into the seal cavity 41*b* while accurately carrying out coaxial alignment merely with use of the single pair of upper and lower holder pair 41U and 41L.

Furthermore, according to the waterproof seal feeding machine 100 in the first embodiment, the hole 31*b* is formed in the tip end of the lock member 31. When the lock member 31 pushes the seal member 2, the hole 31*b* wraps the tip of the small-diametrical part of the seal member 2 so that the seal member 2 precisely coaxially aligns with the seal cavity 41*b*.

The seal member 2 is locked in precise and coaxial alignment with the seal cavity 41*b*, even if various clearance adjustments between the upper and lower holder pair 41U and 41L are necessary in a closest state so as to match with the diameter of the electric wire W.

Furthermore, since the lock member 31 which tightly locks the seal member 2 in the seal cavity 41*b* is coaxially aligned with the electric wire W on the axis line L, the seal member 2 having a smallest difference between the maximal outer diameter and the minimal outer diameter can be securely locked in the seal cavity 41*b*.

Moreover, since the stripping blade pairs 17*a* and 17*b* are constructed integral with the holder driving unit 50 serving as holder driving means, the operations of the holder 41 and the stripping device 17 with respect to the rear end (upstream end) of a preceding cut wire and the front end (downstream end) of an electric wire W following the preceding cut wire can be rendered synchronous with each other.

Second Embodiment

Next, a waterproof seal feeding machine 200 as a second embodiment of the present invention is described in detail referring to FIGS. 14 through 17B. It should be noted that the second to fifth embodiments described with reference to FIG. 14 and thereafter are merely examples of the present invention in which each embodiment is applied to the wire processing apparatus 10 in place of the waterproof seal feeding machine 100.

The waterproof seal feeding machine 200 in the second embodiment is constructed such that preparations or a setup operations in fitting seal members of different sizes over end portions of electric wires of different sizes can be carried out efficiently. Specifically, in the second embodiment, a passage forming member 60, a holder 70, and a locking drive mechanism 87 serving as locking means are integrally replaceable.

Figure 17A:
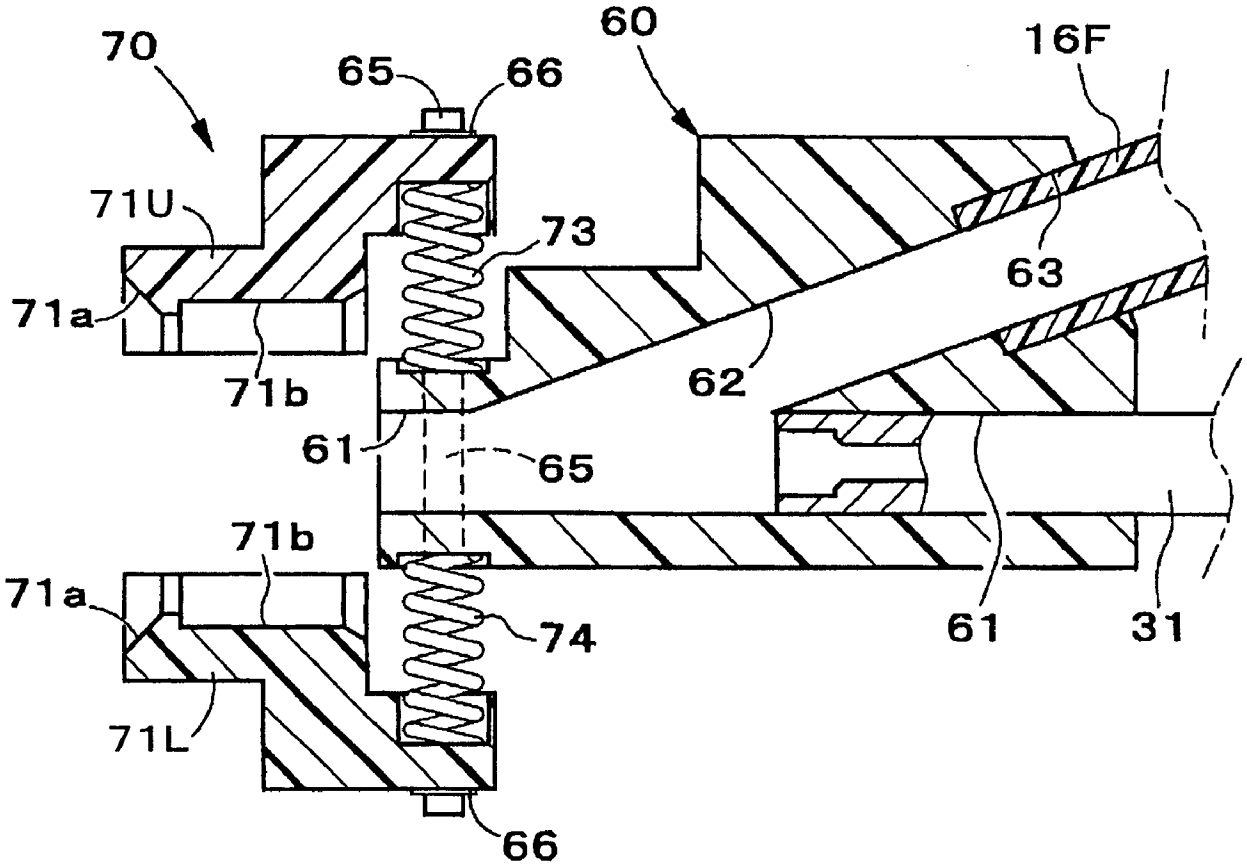
FIGS. 17A and 17B are sectional views each showing a passage forming member and a holder in the second embodiment.
Figure 17B:
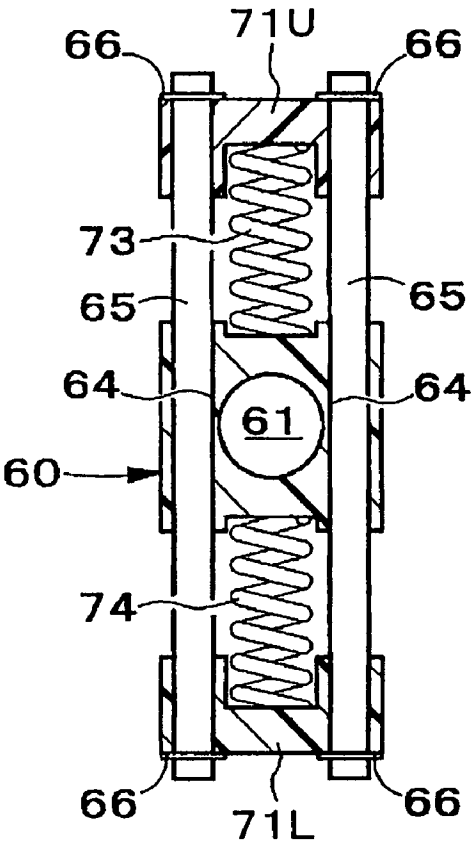

As shown enlargedly in FIGS. 17A and 17B, the passage forming member 60 is formed with an lock member passage 61 for passing a lock member 31, and a feeding passage 62 for feeding a seal member 2.

A pair of through-openings 64 each extending vertically are formed in a front end of the passage forming member 60. These through-openings 64 are parallel with each other in vertical direction and are located at the both sides of the lock member passage 61. A pair of support shafts 65 each extending vertically fit through the respective throughopenings 64.

A pair of upper and lower holder pair 71U and 71L constituting the holder 70 are slidably mounted on the support shafts 65 as opposed to each other vertically to be movable toward and away from each other.

An upper coil spring 73 is disposed between the upper holder member 71U and the passage forming member 60, and a lower coil spring 74 is disposed between the lower holder member 71L and the passage forming member 60 to constantly urge the upper and lower holder pair 71U and 71L upwardly and downwardly, respectively.

A clip 66 is attached to each of upper and lower ends of a pair of support shafts 65 to keep the upper and lower holder pair 71U and 71L from falling off from the support shafts 65.

With this arrangement, the upper and lower holder pair 71U and 71L and the passage forming member 60 are assembled into one unit.

Figure 14:
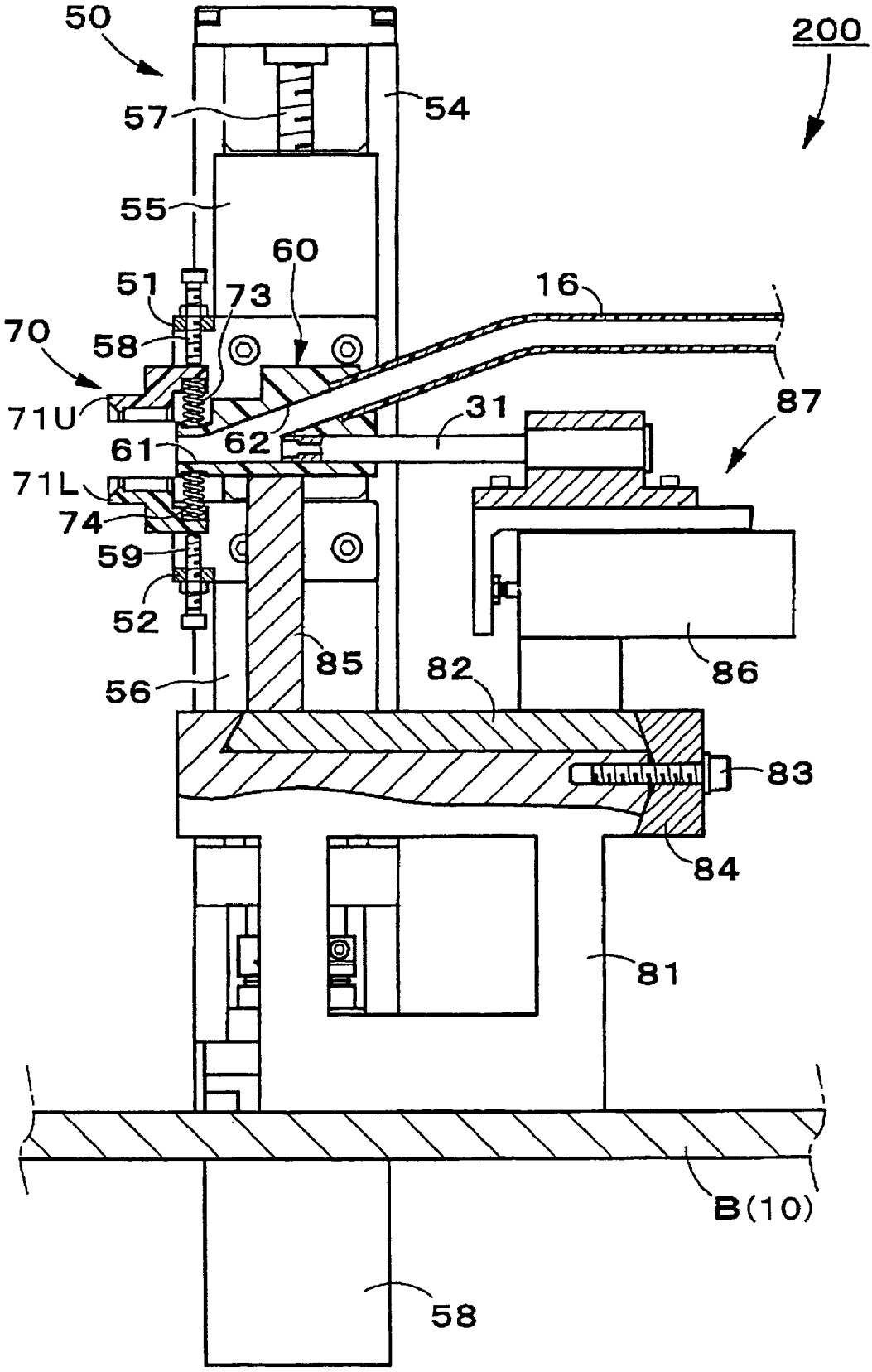
FIG. 14 is a side view showing a waterproof seal feeding machine as a second embodiment of the present invention.

Referring to FIG. 14, a support member 81 stands on a base block B of the wire processing apparatus 10. The support member 81 supports a base member 82 having a trapezoidal shape in cross section. The base member 82 is detachably mounted on the support member 81 by a bolt 83 and a fixing block 84. On the base member 82, integrally provided are a support column 85 for supporting the passage forming member 60, and lock member driving means 87 including an air cylinder 86 for reciprocating the lock member 31 along the axis line L.

With the above arrangement, the passage forming member 60, the upper and lower holder pair 71U and 71L, the lock member 31, and the lock member driving means 87 are replaceable as a unit in altering the setup operation in fitting seal members of different sizes over end portions of electric wires of different sizes. Thus, setup operations for preparing another size can be carried out promptly and efficiently.

A pair of upper and lower bolts 58 and 59 are fastened on a pair of upper and lower brackets 51 and 52 of a holder driving unit 50, respectively, with their vertical positions freely adjustable.

Figure 15:
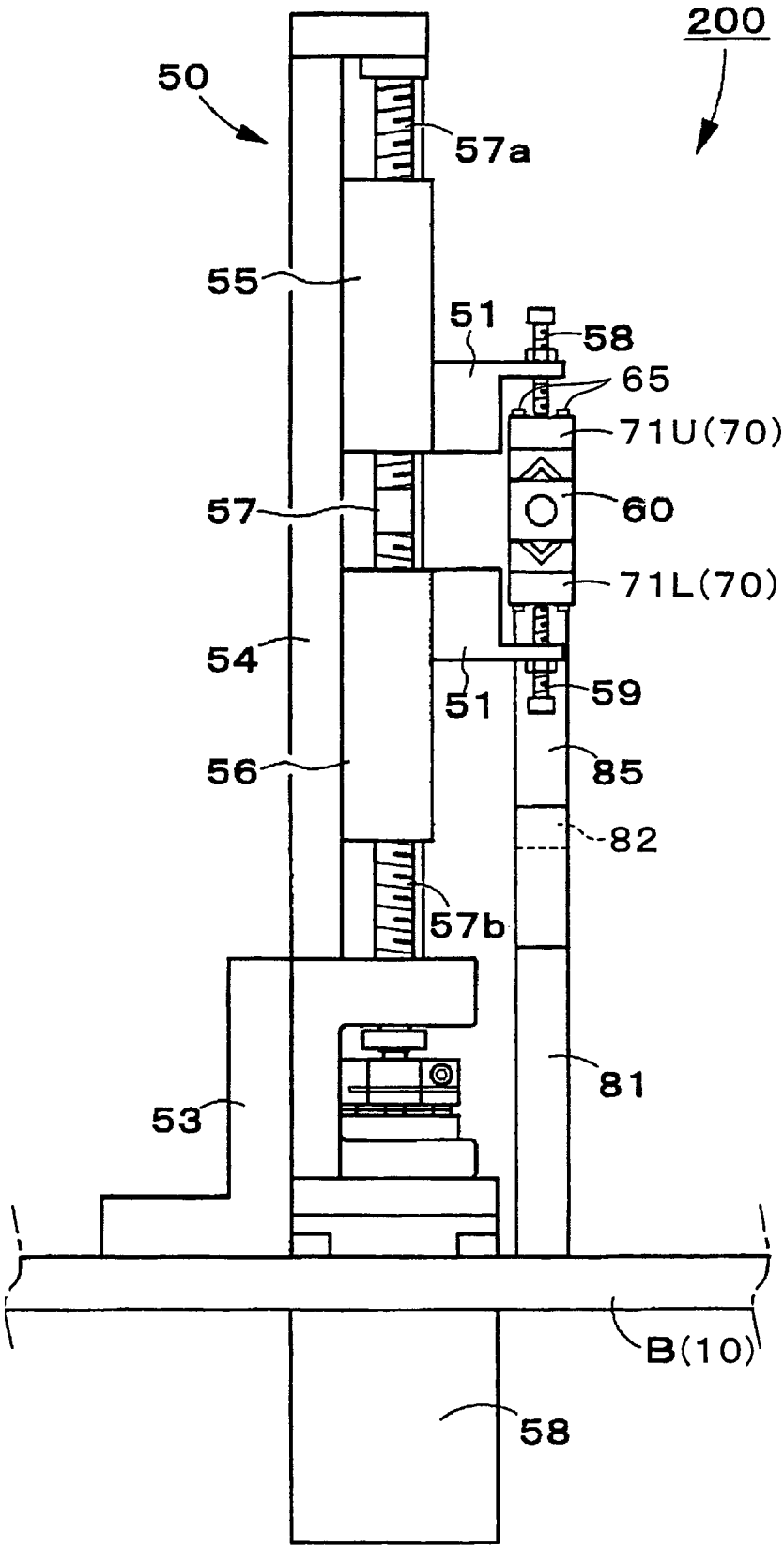
FIG. 15 is a front view of the waterproof seal feeding machine as the second embodiment of the present invention.
Figure 16:
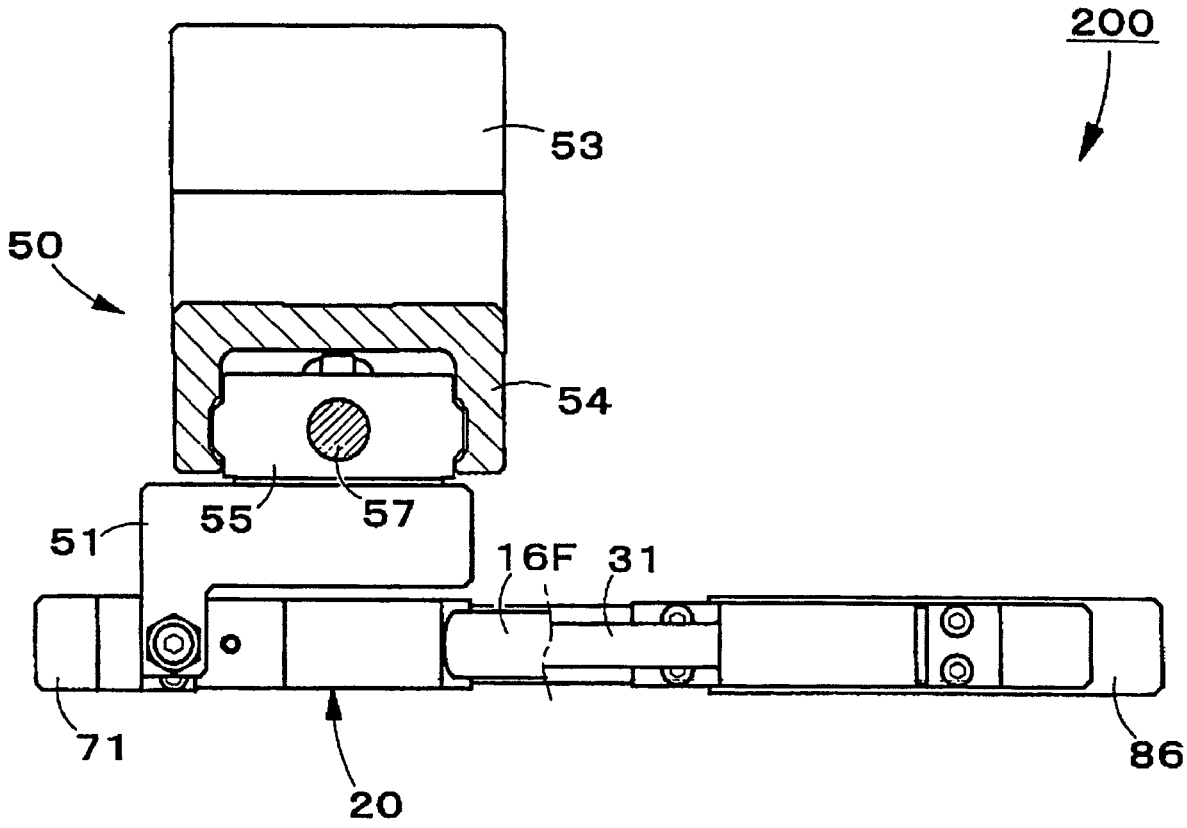
FIG. 16 is a plan view of the waterproof seal feeding machine as the second embodiment of the present invention.

Referring to FIG. 15, the setup operation for preparing fitting operations of seal members 2 of different sizes, a pair of upper and lower sliders 55 and 56 are positioned at their respective positions in such a manner that a lower end of the upper bolt 58 comes into contact with the upper surface of the upper holder member 71U, and an upper end of the lower bolt 59 comes into contact with the lower surface of the lower holder member 71L.

With the above arrangement, the upper and lower holders 71U and 71L move closer to each other by the holder driving unit 50. The holders 71U and 71L move away from each other by urging forces of the upper and lower coil springs 73 and 74 when the holder driving unit 50 drives sliders 55 and 56 (and therefore the brackets 51 and 52) apart from each other.

Third Embodiment

Figure 18:
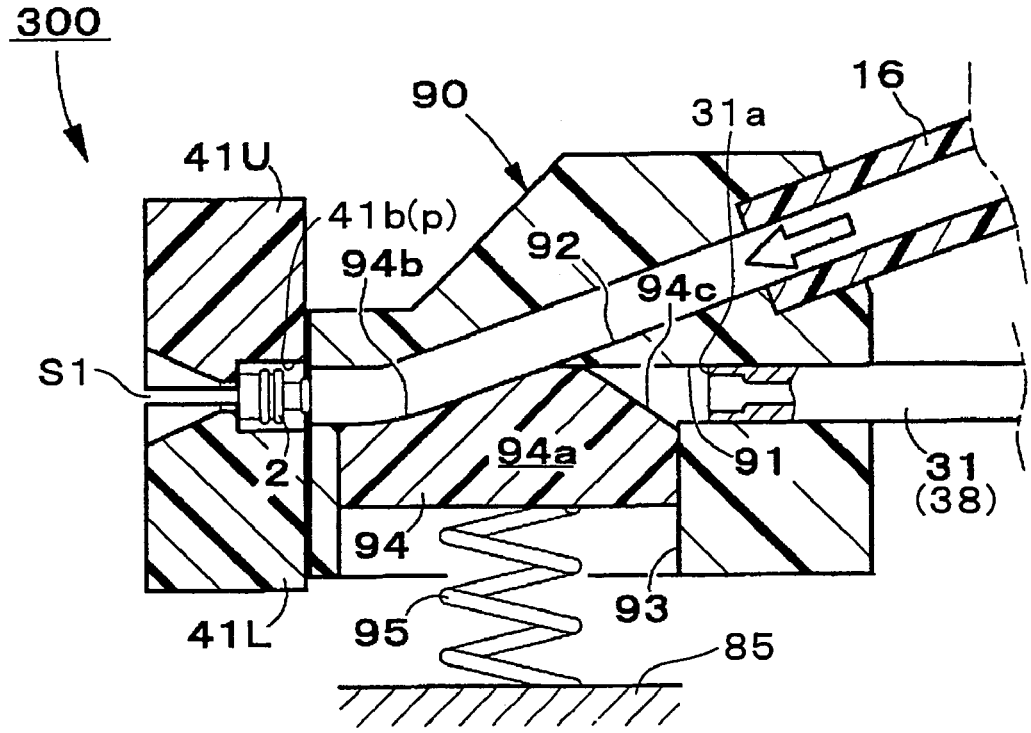
FIG. 18 is a sectional view showing a passage forming member and a holder in a waterproof seal feeding machine as a third embodiment of the present invention in a seal member feeding state.
Figure 19:
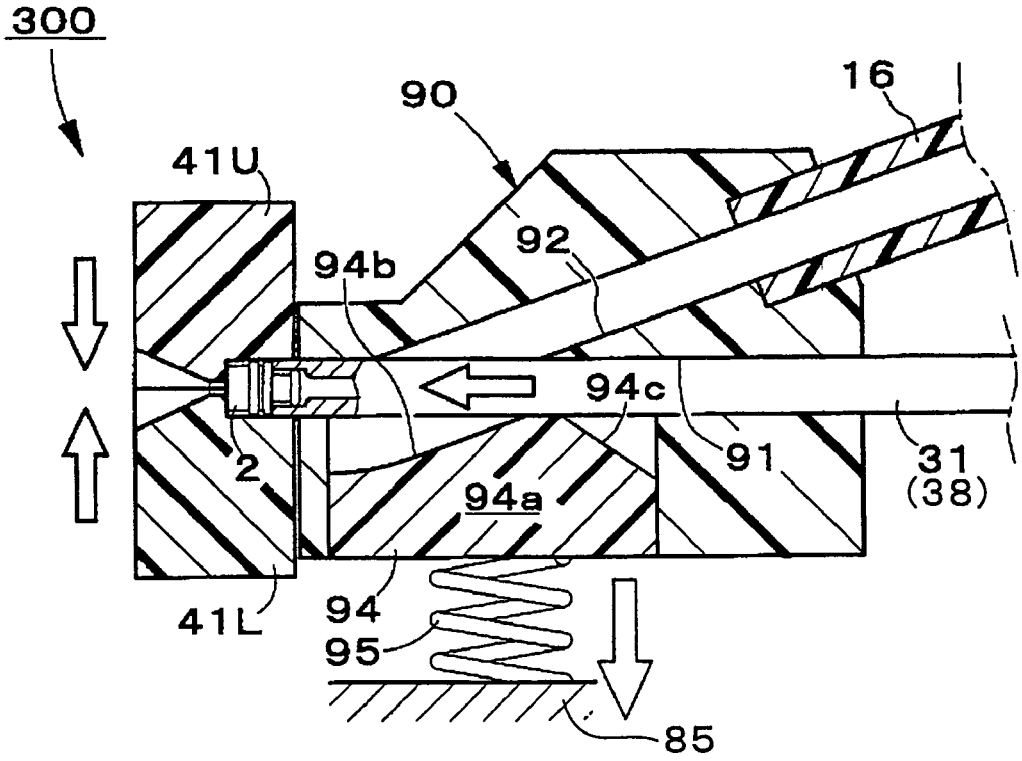
FIG. 19 is a sectional view showing the passage forming member and the holder in the waterproof seal feeding machine as the third embodiment of the present invention in a seal member fixing state.

Next, essential parts of a waterproof seal feeding machine 300 as a third embodiment of the present invention are described referring to FIGS. 18 and 19.

A passage forming member 90 of the waterproof seal feeding machine 300 in the third embodiment is formed with an lock member passage 91 for passing a lock member 31, and a feeding passage 92 for feeding a seal member 2.

A slider 94 is slidable upwardly and downwardly in a slider passage 93 formed in the bottom of the passage forming member 90.

A coil spring 95 is disposed at a lower part of the slider 94 to constantly urge the slider 94 toward the feeding passage 92.

The slider 94 has a main body 94*a* for filling a merging portion of the feeding passage 92 and the lock member passage 91 by the movement into the feeding passage 92. The slider 94 likewise has a surface 94*b* which defines a feeding passage for continuously connecting the feeding passage 92 and a leading opening of the lock member passage 91.

The slider 94 further has a cam surface 94*c*. The cam surface 94*c* receives horizontal force from the tip 31*a* of the fixing member 31 when the fixing member 31 moves toward the holder pair 41U and 41L along with the lock member passage 91. The cam surface 94*c* then changes the direction of the force from horizontal to vertical so that the slider main body 94*a* moves downwardly against the urging force of the coil spring 95. Thus the main body 94*a* opens the lock member passage 91 so as to allow the fixing member 31 to smoothly push the seal member 2 in the seal cavity 41*b*.

In the waterproof seal feeding machine 300 of the third embodiment, the feeding passage 92 and the merging portion or the tip of the lock member passage 91 are continuously connected with each other by the surface 94*b* of the slider 94 when the slider 94 lifts into the feeding passage 92 (see FIG. 18).

With the above arrangement, the seal member 2 can be smoothly fed into a seal cavity 41*b* defined at a fitting position P from a downstream end of the lock member passage 91 by the compressed air without being affected by the existence of the merging portion of the feeding passage 92 and the lock member passage 91.

Furthermore, when the lock member 31 moves toward the upper and lower holder pair 41U and 41L, the cam surface 94*c* of the slider 94 receives the pressure from the tip 31*a* of the lock member 31 and therefore the slider 94 moves downwardly (see FIG. 19). This arrangement is advantageous in guiding smooth movement of the lock member 31 toward the upper and lower holder pair 41U and 41L without hindrance.

In addition, when the lock member 31 is retracted away from the merging portion of the passage forming member 90 in the lock member passage 91, the slider 94 returns into the feeding passage 92 by the urging force of the coil spring 95, thereby continuously connecting the feeding passage 92 and the tip opening of the lock member passage 92.

Fourth Embodiment

Figure 20:
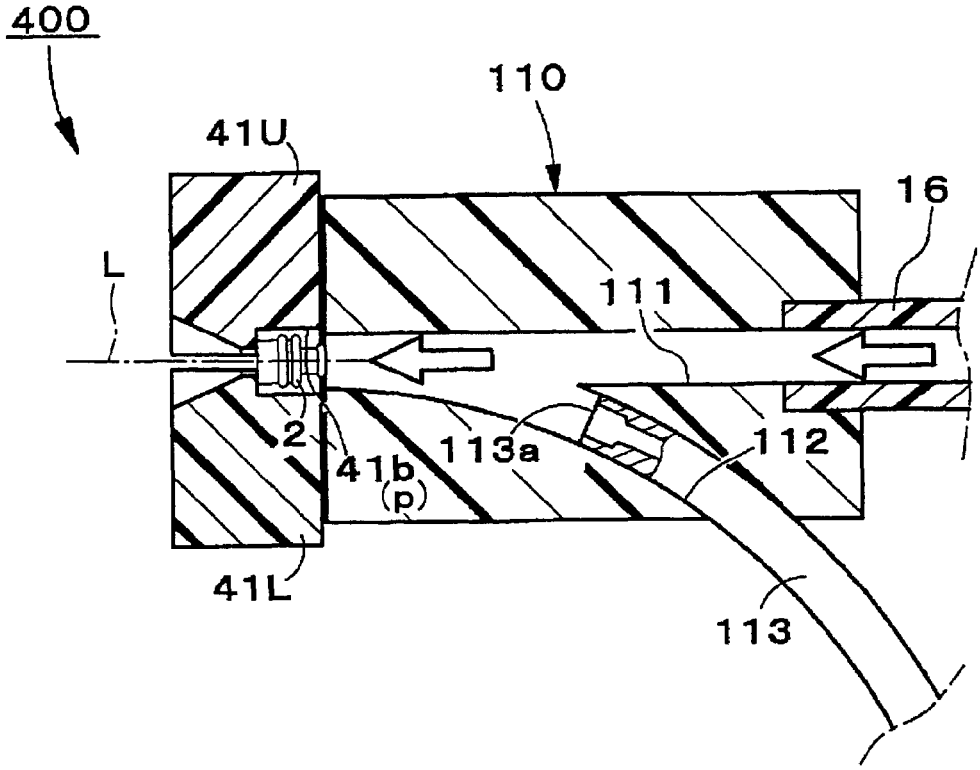
FIG. 20 is a sectional view showing a passage forming member and a holder in a waterproof seal feeding machine as a fourth embodiment of the present invention in a seal member feeding state.
Figure 21:
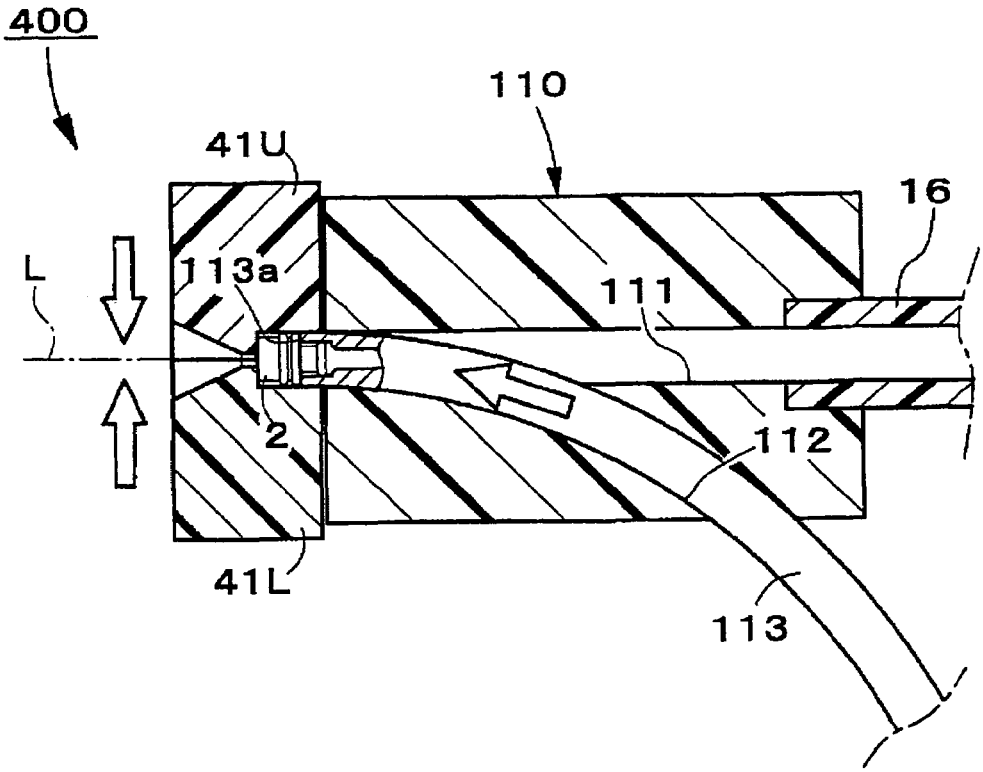
FIG. 21 is a sectional view showing the passage forming member and the holder in the waterproof seal feeding machine as the fourth embodiment of the present invention in a seal member fixing state.

Next, essential parts of a waterproof seal feeding machine 400 as a fourth embodiment of the present invention are described referring to FIGS. 20 and 21.

The waterproof seal feeding machine 400 in the fourth embodiment is constructed such that a feeding passage 111, for feeding a seal member 2 in a seal cavity 41*b*, is formed coaxially with the axis line L.

Further, the waterproof seal feeding machine 400 is formed with an lock member passage 112 which is merged into the feeding passage 111 at a downstream end of the feeding passage 111 and extends downward in an arc-shape in side view.

A lock member 113 has a curved rod-like shape having such a curvature as to match with the curvature of the lock member passage 112.

The lock member 113 is so constructed that a tip surface 113*a* thereof extends in a direction orthogonal to the axis line L when the tip surface 113*a* is abutted against the seal member 2.

The above arrangement is advantageous in keeping a seal member 2 having a relatively short length in the axis line L from being tilted relative to the axis line L on the way of feeding toward the seal cavity 41*b* by the compressed air.

Fifth Embodiment

Figure 22:
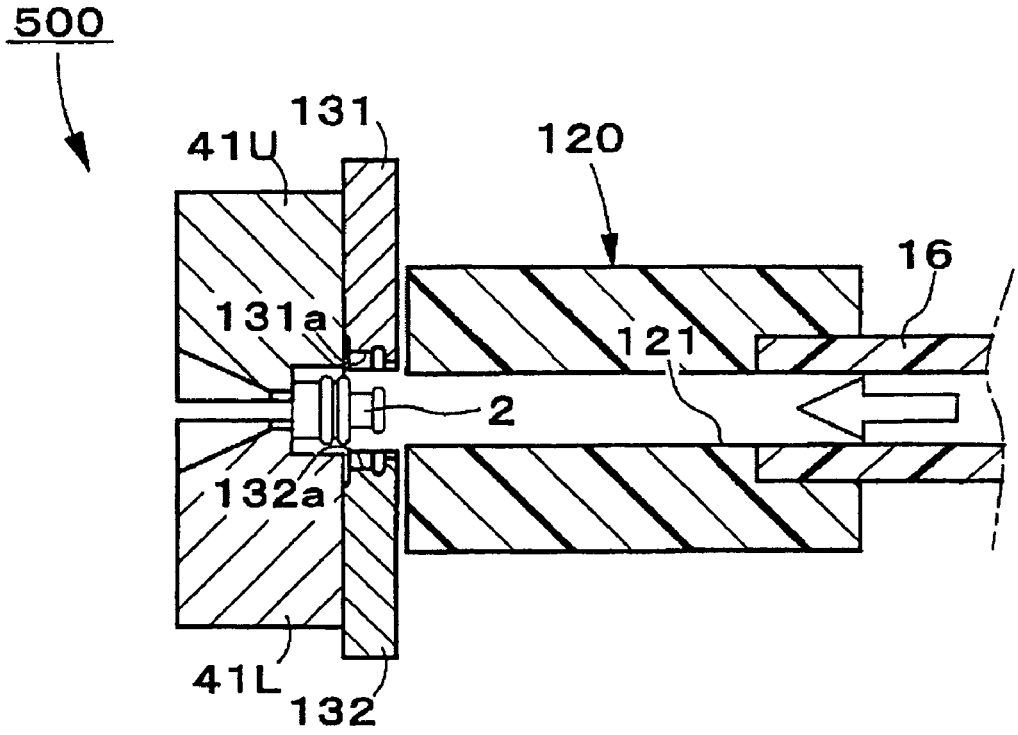
FIG. 22 is a sectional view showing a passage forming member and a holder in a waterproof seal feeding machine as a fifth embodiment of the present invention in a seal member feeding state.
Figure 23:
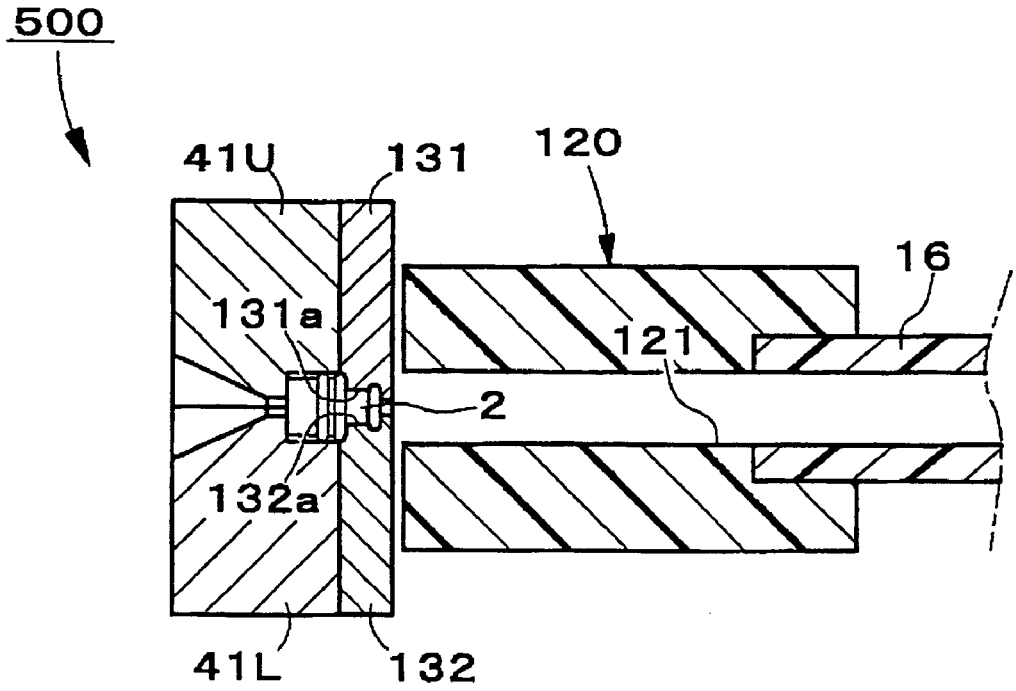
FIG. 23 is a sectional view showing the passage forming member and the holder in the waterproof seal feeding machine as the fifth embodiment of the present invention in a seal member fixing state.

Next, essential parts of a waterproof seal feeding machine 500 as a fifth embodiment of the present invention are described referring to FIGS. 22 and 23.

A passage forming member 120 of the waterproof seal feeding machine 500 is merely formed with a feeding passage 121 for feeding a seal member 2.

A pair of plate members 131 and 132 which are so constructed as to be vertically movable toward and away from each other serve as fixing means for fixing the seal member 2 in a seal cavity 41*b* defined by a pair of upper and lower holder pair 41U and 41L.

The plate members 131 and 132 are respectively formed with enclosing recesses 131*a* and 132*a* for enclosing the seal member 2 held in the seal cavity 41*b* in a closest position of the plate members 131 and 132.

The plate members 131 and 132 are upwardly and downwardly driven by unillustrated dedicated driving means.

As mentioned above, in the waterproof seal feeding machine 500, the passage forming member 120 is formed merely with the feeding passage 121.

The feeding passage 121 is constructed without considering the construction of an lock member passage for passing a lock member. This arrangement is advantageous in securely keeping a seal member 2 having a relatively short length in the axis line of an electric wire from being tilted relative to the axis line on the way of feeding toward a seal cavity 41*b* by the compressed air.

The seal member 2 can be securely held in the seal cavity 41*b* under continued supply of the compressed air until the lock members 131 and 132 are actuated by continuously supplying the compressed air after the seal member 2 is fed into the seal cavity 41*b*.

As mentioned above, the waterproof seal feeding machines according to the respective embodiments of the present invention are described in detail. It should be understood that the present invention is not limited to the foregoing embodiments, and various modifications and alterations are applicable.

For instance, in the foregoing embodiments, the lock members denoted at the reference numerals such as 31, 32, 33, and 113 each has a rod-like shape. Alternatively, use of a coil spring as a lock member may be advantageous because the coil spring is capable of adjusting the pressing force of pressing the seal member 2 against the bottom of the seal cavity 41*b*.

In the above embodiments, the passage forming member is made of a synthetic resin. As an altered form, the passage forming member may be made of a metallic material or the like.

As is obvious from the above description, the waterproof seal feeding machines 100, 200, 300, 400, and 500 according to the respective embodiments of the present invention are each constructed such that the seal member 2 is directly fed into the seal cavity 41*b* by the compressed air. This is advantageous in feeding the seal member 2 within a very short cycle of time. Thus, a feeding cycle of the seal member 2 can be shortened, and fitting operation of the seal member 2 over the end portion of the electric wire W can be carried out efficiently.

Further, since the seal member 2 fed into the seal cavity 41*b* is fixedly held therein by the lock member 31, 113, or the like, the fitting operation of the seal member 2 over the end portion of the electric wire W can be performed securely.

Furthermore, since the feeding passage 22 (62, 92, 111) joins the lock member passage 21 (61, 91, 112) on the halfway of feeding the seal member 2, the seal member 2 can be securely fed into the seal cavity 41*b* without likelihood that the seal member 2 is tiltingly fed relative to the axis line of the electric wire W.

As described in the fourth embodiment and the fifth embodiment, arranging the feeding passage 92 (111) for feeding the seal member 2 into the seal cavity 41*b* coaxially and linearly along the axis line of the electric wire W is advantageous in securely feeding the seal member 2 having a relatively short length in the axis line of the electric wire W into the seal cavity 41*b* without likelihood that the seal member 2 is tiltingly fed relative to the axis line of the electric wire W.

The fifth embodiment provides the arrangement in which the passage forming member 120 is merely formed with the feeding passage 111. This arrangement is advantageous in securely feeding the seal member 2 of a relatively short length in the axis line of the electric wire W into the seal cavity 41*b* without likelihood that the seal member 2 is tiltingly fed relative to the axis line of the electric wire W.

In the foregoing embodiments, in feeding the seal member 2, the air inside the feeding passage 22 (62, 92, 111) which has been penetrated into the seal cavity 41*b* prior to feeding of the seal member 2 is exhaled through the clearance S1 defined by the holder pair 41U and 41L (42U and 42L, 43U and 43L, 71U and 71L). This arrangement is advantageous in securely feeding the seal member 2 into the seal cavity 41*b*. Further, the holder pair 41U and 41L (42U and 42L, 43U and 43L, 71U and 71L) are rendered into contact with each other at the completion of feeding of the seal member 2. This arrangement is advantageous in holding the seal member 2 in the seal cavity 41*b* with the seal member 2 being aligned coaxially with the axis of the electric wire W.

Further, in feeding the seal member 2, the air inside the feeding passage 22 (62, 92, 111) which has been penetrated into the seal cavity 41*b* prior to feeding of the seal member 2 is exhaled through the clearance defined by the holder pair and the passage forming member 20 (60, 90, 110, 120). This arrangement is advantageous in securely feeding the seal member 2 into the seal cavity 41*b*.

In the second embodiment, in changing the size of seal member 2, the holder pair 71U and 71L and the passage forming member 60 are integrally replaceable. This arrangement is advantageous in promptly altering the setup operation in fitting the seal member 2 of different sizes over the end portion of the electric wire W.

Furthermore, the through-opening 41*a* formed in the end wall of the seal cavity 41*b* has a rectangular (rhombus) shape in cross section, and the distance between the holder pair 41U and 41L (42U and 42L, 43U and 43L, 71U and 71L) in a closest position is adjustable in conformity to the outer diameter of seal member 2. This arrangement is advantageous in eliminating necessity of replacing the holder pair 41U and 41L (42U and 42L, 43U and 43L, 71U and 71L) with another pair of holder pair in changing the thickness of the electric wire W without changing the diameter of the seal member 2.

Furthermore, in locking the seal member 2 in the seal cavity 41*b*, the lock member 31 (113) is adapted to position the seal member 2 in coaxial alignment with the seal cavity 41*b*. This arrangement is advantageous in holding the seal member 2 coaxially with the electric wire W in adjusting the distance between the holder pair 41U and 41L (42U and 42U, 43U and 43L, 71U and 71L) in a closest position.

Further, the feeding passage 22 (62, 92, 111) and the tip opening of the lock member passage 21 (61, 91, 112) can be continuously connected with each other by filling a space corresponding to the merging portion of the feeding passage 22 (62, 92, 111) and the lock member passage 21 (61, 91, 112) with the slider which is so constructed as to reciprocatably and slidably move in and out of the passage forming member 20 (60, 90, 110, 120). This arrangement is advantageous in smoothly feeding the seal member 2 into the seal cavity 41*b* by the compressed air.

Moreover, the compressed air is kept on being supplied into the feeding passage 22 (62, 92, 111) after the seal member 2 is fed into the seal cavity 41*b*. This arrangement is advantageous in securely holding the seal member 2 in the seal cavity 41*b* by the pressure of the compressed air until the lock member 31 (113) is actuated.

This application is based on Japanese patent application serial No. 2003-012607, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A method for fitting cylindrical waterproof seal members over end portions of an electric wire, comprising:

a seal cavity defining step of defining a seal cavity for receiving a cylindrical waterproof seal member at a predetermined fitting position on an axis line of an electric wire;

a feeding step of feeding the seal member by compressed air along the axis line and into the seal cavity at the fitting position with such a posture as to receive the electric wire;

a locking step of bringing the seal member to a locked state in the seal cavity so that the seal member is prevented from moving along the axis line;

an inserting step of inserting the electric wire into the seal member along the axis line while the seal member is in the locked state; and a releasing step of releasing the seal member from the locked state after the inserting step.

2. The method according to claim 1, wherein the seal cavity is defined by moving a holder pair toward each other to close the fitting position with regard to the axis line, the holder pair are slightly moved away from each other to define an air exhaling path for exhaling the air penetrated in the seal cavity through the feeding passage while the seal member is held in the seal cavity.

3. The method according to claim 1, wherein the feeding step feeds the seal member in a first direction along the axis line, and wherein the inserting step inserts the electric wire in a second direction along the axis line and opposed to the first direction.

4. The method according to claim 1, wherein the locking step is conducted by using a rod-shaped lock member having a substantially circular shape in cross section to accommodate the seal member in such a way to allow the end portion of the electric wire to insert the seal member in the locked state.

5. A method for fitting substantially cylindrical waterproof seal members over end portions of an electric wire, comprising:

defining a seal cavity for receiving a cylindrical waterproof seal member, the seal cavity being on an axis line;

feeding the seal member by compressed air directly into the seal cavity on the axis line so that the seal member is fed in a posture along the axis line to receive the electric wire;

locking the seal member in the seal cavity so that the seal member is substantially prevented from moving;

aligning the electric wire so that an axis of the wire at the end portion of the wire extends substantially along the axis line; inserting the electric wire along the axis line and into the seal member while the seal is locked; and releasing the seal member from the locked state after inserting the electric wire.

6. The method according to claim 5, wherein the step of locking the seal member is conducted by using a rod-shaped lock member having a substantially circulair shape in cross section to accommodate the seal member in such a way to allow the end portion of the electric wire to insert the seal member in the locked state.

* * * * *